US006837412B2

(12) United States Patent
Lamb

(10) Patent No.: US 6,837,412 B2
(45) Date of Patent: Jan. 4, 2005

(54) CAP FEEDING APPARATUS FOR A FASTENER GUN

(75) Inventor: Frederick W. Lamb, Alabaster, AL (US)

(73) Assignee: PneuTools, Incorporated, Cordova, TN (US)

( * ) Notice: Subject to any disclaimer, the term of this patent is extended or adjusted under 35 U.S.C. 154(b) by 0 days.

(21) Appl. No.: 10/635,861

(22) Filed: Aug. 5, 2003

(65) Prior Publication Data

US 2004/0112933 A1 Jun. 17, 2004

Related U.S. Application Data

(60) Provisional application No. 60/401,106, filed on Aug. 5, 2002, and provisional application No. 60/471,881, filed on May 20, 2003.

(51) Int. Cl.[7] ..... B27F 7/02

(52) U.S. Cl. ..... 227/18; 227/120; 227/50; 227/135; 227/137

(58) Field of Search ..... 227/15, 16, 18, 227/39, 48, 50, 120, 135, 136, 137, 138, 132

(56) References Cited

U.S. PATENT DOCUMENTS 3,595,460 A * 7/1971 Pitkin ..... 227/32
5,184,752 A * 2/1993 Zylka et al. ..... 221/1
5,339,983 A * 8/1994 Caple ..... 221/25
5,407,313 A 4/1995 Bruins
5,634,583 A * 6/1997 McGuinness et al. ..... 227/120
5,934,504 A * 8/1999 Elliott ..... 221/232
5,947,362 A * 9/1999 Omli ..... 227/120
6,010,291 A 1/2000 Schwingle
6,302,310 B1 * 10/2001 Lamb ..... 227/119
6,471,107 B2 10/2002 Liu et al.
6,478,209 B1 * 11/2002 Bruins et al. ..... 227/16
6,481,610 B1 * 11/2002 Liu et al. ..... 227/18
6,508,392 B1 1/2003 Huang
2003/0015565 A1 1/2003 Lee

* cited by examiner

*Primary Examiner*—Scott A. Smith
*Assistant Examiner*—Nathaniel Chukwurah
(74) *Attorney, Agent, or Firm*—Walker, McKenzie & Walker, P.C.

(57) ABSTRACT

A construction tool and method of use for affixing holding cap washers to roofing paper and building wrap tar paper. The tool is a combination of a fastener-driving gun together with a feeding magazine holding a clip of plastic cap washers to be affixed, and the feed magazine feeds successive cap washers under the nose of the fastener-driving gun so that fasteners, such as nails or staples, can penetrate the cap washer and hold down the roofing paper or building wrap tar paper. As the cap approaches the nose of the gun, the cap feeder flips the cap ninety degrees along an axis transverse to the feed direction. A shortened shuttle is used with a spring arm holding one edge of the leading cap in the magazine and the rearward portion of the shuttle holding the other edge of the leading cap.

5 Claims, 20 Drawing Sheets

CAP FEEDING APPARATUS FOR A FASTENER GUN

CROSS REFERENCE TO RELATED APPLICATIONS

This application is a non-provisional application claiming priority of pending U.S. provisional application 60/401,106 (filed Aug. 5, 2002) entitled "Tool and Method for Fastening Hold-Down Cap Washers," fully incorporated herein by reference. Additionally, this application is a non-provisional application corresponding to and claiming priority of pending U.S. provisional application 60/471,881 (filed May 20, 2003) entitled "Tool and Method for Fastening Hold-Down Cap Washers," fully incorporated herein by reference.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to building construction tools, and in particular, to fastener driving tools for driving staples and nails and the like through cap washers.

2. Description of Related Art

It is often desired to use plastic cap washers to hold down roofing paper and so-called building wrap tar paper. Well-known solutions for this problem include providing plastic cap washers in bulk, each having a nail pre-inserted through the plastic cap washer, and a hammer is then used by a construction worker to pound the nail through roofing paper or tar paper wrapping and into a building. Application of such plastic cap washers to hold down roofing paper or tar paper wrapping is manual, tedious, and slow.

Automatic nail and staple guns, powered by compressed air or electricity, are used, for example, to attach roofing material, such as tarpaper, to the roof of a house. A generally fat cap is often used with each nail. A nail penetrates the cap and the tarpaper and protrudes into the underlying roof structure, attaching the roof surface. One example of such caps is disclosed in Bruins, U.S. Pat. No. 5,407,313 (issued Apr. 18, 1995).

Typically, an operator must manually place and hold a cap under the nose of a nail gun and then trigger the gun to drive a nail through the cap into the roof structure. The manual placement of caps presents a serious safety hazard to the operator because the operator's hand is close to the nose of the gun. In addition, manual placement of caps is time-consuming and inefficient. Another way the caps are made is with the nail already pressed through the center of the cap. One example of such caps is disclosed in Schwingle, U.S. Pat. No. 6,010,291 (issued Jan. 4, 2000). The installer of the cap must take each cap/nail and hand bang them on to the work surface with a hammer. This is very time consuming and difficult, not only hard on the back but hard on the fingers.

A cap feeding device may be employed to reduce the risk associated with manual placement of caps and to improve the efficiency of the roofing operation. The cap feeding device automatically places a cap under the nose of a fastener gun, and then the gun drives a nail through the cap and into the underlying structure.

Prior art cap feeding devices generally include a cap magazine and a base having an elongated channel. The base extends between the cap magazine and a position under the nose of the fastener gun. It shall be understood that the term "fastener gun" is used herein to indicate staple guns, nail guns, and similar construction tools for shooting a fastener, all of which can be used to affix caps by a construction worker. Caps are fed into the channel of the base from the cap magazine and pushed or pulled into position under the nose of the fastener gun. When the gun is triggered, a nail penetrates and dislodges the cap under the nose of the nail gun and protrudes into the underlying structure. The feeding of the caps under the nose of the nail gun is coordinated with the ejection of the nails through the nose of the nail gun, so that a cap is placed under the nose of the gun before the gun is triggered to expel a fastener.

Such prior art cap feeding devices have a number of drawbacks. For example, prior art cap feeding devices are generally heavy, putting additional stress on the operator's hand holding the fastener gun. Also, many prior art cap feeding devices can only be installed close to the front end of a fastener gun, making the fastener gun not only heavy but also unbalanced with most of the weight placed at the front end of the gun. This makes the nail or staple gun difficult to handle and may put stress on the operator's hand and wrist. In addition, with so many components placed at the front end or side of the tool it is difficult to see the position of the nose of the gun, making a precise placement of the nail difficult.

The conventional cap feeding devices are installed close to the front end of the gun because designers need to place a conventional cap magazine close to the nose of the gun to reduce the weight of the cap feeding device. The reason is that in many devices a cap is pushed directly from the cap magazine to a position under the nose of the gun. Thus, if the cap magazine is far from the nose of the gun, a long shuttle (with a correspondingly long reciprocating stroke) is needed to push a cap from the magazine into position under the nose of the fastener gun through the channel of the base. In addition, an actuator, such as an air cylinder, with a long displacement stroke, is also needed to drive the shuttle. The displacement stroke of the actuator should be about the same as the distance between the cap magazine and the nose of the fastener gun. A long shuttle and actuator increase the weight and size of the cap feeding device. With the cap feeding device placed near the nose of the gun, the shuttle and actuator, and thus the cap feeding device, can be made lighter, smaller and less expensive.

It is therefore desirable to have an automated construction tool and method of using same that provides for easier installation of such plastic cap washers than has been heretofore possible in the prior art. It is further desirable to have a lightweight cap feeding apparatus for use with a fastener gun that allows a magazine of caps and the cap feeding apparatus to be placed very close to the nose of the gun.

BRIEF SUMMARY OF THE INVENTION

The present invention is a cap feeding apparatus for use in combination with a fastener gun, thereby creating a construction tool that is a combination of a fastener-driving gun with a feeding magazine holding a clip of plastic cap washers to be affixed to a surface.

Three preferred embodiments of the invention are disclosed. The first two embodiments are a cap feeding apparatus for use in combination with a staple gun, and, specifically, a well-known bottom-load staple gun. The third embodiment is a cap feeding apparatus for use in combination with a well-known nail gun that shoots successive nails from a coil of nails.

A first preferred common feature of all three embodiments is that the cap feeding apparatus receives caps in succession from a magazine of caps and then flips each cap about an axis transverse to the feed direction, preferably about ninety degrees of flip, as the cap is placed under the nose of the fastener gun. A shuttle reciprocates from a cap-receiving position, in which the shuttle is substantially aligned with the cap magazine's leading cap, to a cap-ejecting position in which the shuttle is not aligned with the cap magazine's leading cap.

The first embodiment uses compression springs to bias the cap shuttle into its cap-ejecting position, and the shuttle is moved into its cap-receiving position, with simultaneous compressing of the compression springs, as the shuttle's feet are pressed against the workpiece. The second and third embodiments use an air cylinder to reciprocate the shuttle from the cap-ejecting position to the cap receiving position and back.

A second preferred common feature of all three embodiments is that, when the shuttle is in the cap-ejecting position, the rearward edge of the shuttle engages the leading portion of the leading cap in the magazine, while the trailing portion of the leading cap in the magazine is retained by a biasing spring. As the shuttle reciprocates from the cap-ejecting position to the cap receiving position, the rearward edge of the shuttle slides over the face of the leading cap in the magazine and between the biasing spring and the trailing portion of the leading cap. As the shuttle continues its reciprocation into the cap-receiving position, and the forward edge of the shuttle just passes the trailing portion of the leading cap, the leading cap is pushed from the magazine to a position in the feeding chamber immediately below the forward edge of the shuttle so that the shuttle, upon reversing the direction of reciprocation, can pull the leading cap through and then out of the feeding chamber. This use of both edges of the shuttle, with the rearward edge of the shuttle retaining the leading portion of the leading cap when the shuttle is in the cap-ejecting position in combination with the in spring retaining means engaging the trailing portion of the leading cap in the magazine, and with the forward edge of the shuttle feeding the leading cap from the magazine and out of the feeding chamber, allows the shuttle to have greatly reduced height above its leading edge, thereby allowing the cap feeding apparatus to be much closer to the nose of the gun and permitting a shorter shuttle stroke and lighter-weight cap feeding apparatus than heretofore possible.

This invention provides a compact, light-weight cap feeding devise that overcomes the problems associated with conventional nail/staple guns and cap feeding devices. This invention provides a way that one end of the container/magazine can be placed right next to the nose of the fastener gun with the cap magazine being located directly under the fastener gun's handle. This makes for a substantially perfectly-balanced tool, as well as providing improved view of the cap during shooting of the fastener.

The first embodiment of the invention feeds the caps without use of an air cylinder to reciprocate the shuttle, which feeds the caps naturally and automatically as the fastener gun is brought toward and away from the workpiece surface in the natural nailing or stapling motion of the construction worker. Because the movement of the shuttle of the first embodiment is a natural byproduct of the nailing or stapling motion, no four-way valve is needed to control an actuator cylinder, simply because there is no actuator cylinder with the first embodiment. All embodiments of the invention have no need for a long base or channel to feed the caps to the nose of the fastener gun.

It is an object of the present invention to provide for easier and more rapid installation of cap washers using a fastener-driving gun than heretofore possible.

BRIEF DESCRIPTION OF THE SEVERAL VIEWS OF THE DRAWING

FIGS. 1 through 10B show a first embodiment of the present invention.

FIG. 1 is a perspective view of a first embodiment of the cap feeding apparatus of the present invention in combination with a bottom-feeding staple gun, and in which the cap shuttle is biased toward one end of its reciprocation stroke by compression springs.

FIG. 2 is a perspective view of the first embodiment of the cap feeding apparatus of the present invention with the staple gun removed and with some parts removed and with some hidden portions shown for explanation.

FIG. 3 is an exploded perspective view of FIG. 2, showing how various parts are assembled together.

FIG. 4 is an exploded perspective view of the cap pusher means of the cap magazine, and showing the magazine door through which caps are loaded into the magazine.

FIGS. 5A through 10B are sectional views showing the reciprocation of the shuttle and the feeding of caps by the first embodiment of the present invention. The views with an "A" suffix are similar side sectional views taken substantially along the center line of the cap magazine and show the feed path of the caps through the feeding chamber. The views with a "B" suffix are similar transverse sectional views taken along the indicated view line in the respective view with an "A" suffix.

FIG. 5A is a longitudinal sectional view of the cap feeding apparatus showing caps loaded in the cap magazine and the shuttle in the cap-ejecting position with no cap yet fed.

FIG. 9A is identical to FIG. 5A except that a cap has been fed and is now held into position for receiving a fastener from the fastener gun.

FIG. 10B is a transverse sectional view of the cap feeding apparatus taken substantially along the line 10B—10B shown in FIG. 10A.

FIG. 11 is an exploded perspective view of a second embodiment of the cap feeding apparatus of the present invention in combination with a bottom-feeding staple gun, and in which the cap shuttle is reciprocated by an air cylinder actuator.

FIG. 12 is a close-up front side perspective view of the second embodiment, showing details of the notch on the shuttle arm for receiving the pin of the air cylinder actuator.

FIG. 13 is a close-up front side perspective view of the second embodiment, showing the details of air cylinder actuator pin engaging the notch of the shuttle arm. The cover/guide of the air cylinder actuator has been removed to show these details.

FIG. 14 is a perspective view of the second embodiment of the cap feeding apparatus mounted to a bottom load staple gun.

FIG. 15 is a partial side view of the bottom-load staple gun, showing how the cap feeding apparatus telescopes apart after the air cylinder actuator pin emerges from the notch of the shuttle arm to permit loading of the staple gun. The air cylinder is hidden on the back side of the staple gun in this view.

FIG. 16 is a partial side perspective view similar to FIG. 15 but from the other side and with the staple gun upside down, as is customary for ease of loading staples into the gun.

FIG. 17 is an exploded perspective view of a third embodiment of the cap feeding apparatus of the present invention in combination with a top-load pneumatic nail gun, and in which the cap shuttle is reciprocated by an air cylinder actuator and the cap feeding apparatus is integrated into the gun.

FIG. 18 is side perspective view of the third embodiment in which the cap feeding apparatus does not telescope apart and the pneumatic air cylinder actuator does not separate from the shuttle arm.

FIG. 19 is a perspective view of the other side of the third embodiment, showing details of the air feed-air return air cylinder actuator that reciprocates the shuttle.

FIG. 20 is an enlarged rear perspective view of the shuttle of the third embodiment, showing details of the shuttle arm.

DETAILED DESCRIPTION OF THE INVENTION

Figure 1:
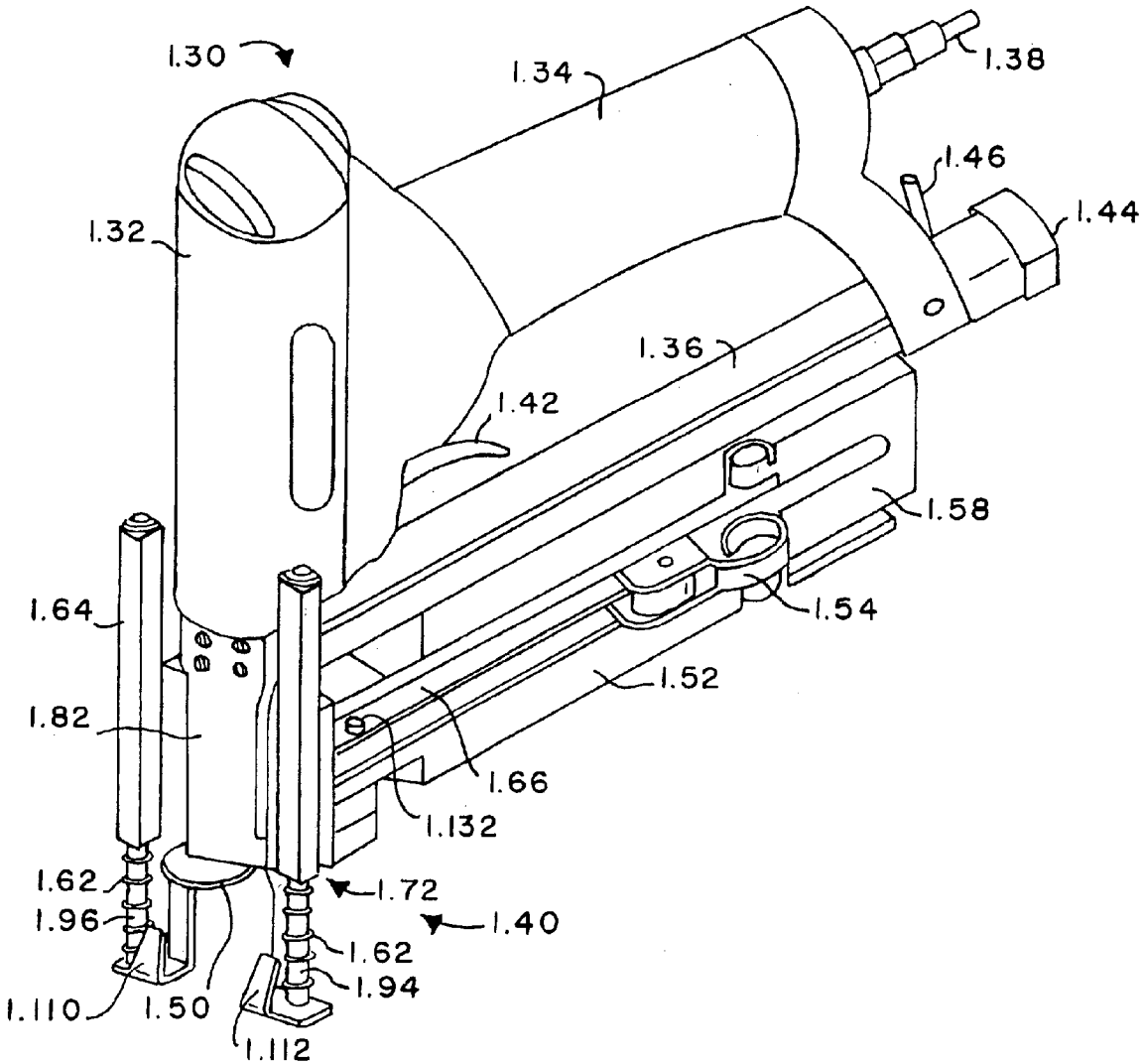

The drawing figures show three preferred embodiments of the present invention. All embodiments have many similarities, and, after describing the first embodiment and its use and operation in detail, only the differences of the second and third embodiments will be discussed in detail, it being understood that similar structures in all embodiments perform similar functions. For clarity, reference numerals for the three embodiments will have respective prefixes of "1.", "2.", and "3." to denote the individual embodiments, and similar suffixes for the reference numerals will be used to indicate similar structure between the three embodiments.

Referring to FIGS. 1–10B, the fastener gun 1.30 used with the first embodiment is a well-known so-called "80-Series" staple/nail gun. One such staple/nail gun that is suitable for use with the first embodiment of the present invention is a model number S80/16 LN-A1 staple gun made and sold by Basso Corp., NO.24 36th Rd., Taichung Ind. Park, Taichung, Taiwan, R.O.C.

Well-known staple gun 1.30 has a main body portion 1.32 and a handle portion 1.34. The tool 1.30 is provided with a magazine 1.36 for staples/nails. When the cap feeding apparatus 1.40 of the present invention (see, e.g., FIG. 2) is used in combination with staple gun 1.30, an improved staple gun 1.30 results. The tool 1.30 is illustrated as being a compressed air actuated tool, the rearward end of the handle portion 1.34 having a air plug 1.38 where an air hose, not shown, can be attached and removed. This hose would lead to a well-known compressed air source, not shown.

The main body portion 1.32 of the tool houses a main cylinder (not shown) containing a piston driver blade (not shown). The main cylinder is connected to air under pressure by means of a main valve (not shown) to force the piston/driver blade downwardly to drive a nail/staple into the work surface. The main valve is actuated by a trigger valve (not shown). A trigger 1.42 operates the trigger valve. This valve actuation mechanism just described within the main body portion 1.32 is well known in the art. The precise nature of the tool 1.30 is not a limitation of the present invention. There are many other ways that fastener driving tools can be actuated, such as internal combustion means, electrical means, and the like.

This staple gun by itself is made up of what has previously been described together with an outer magazine 1.36 and an inner magazine 1.44. To load this magazine with staples, the user must first pick the tool up by the handle portion 1.34 and push the magazine release latch 1.46. This will allow the tool 1.30 and the outer magazine 1.36 to slide forward opening the bottom side (not shown) of the outer magazine 1.36. The user must then turn the tool upside down so that staples can be loaded into the underside of the outer magazine 1.36.

Such staple guns as this are known as bottom-load staple guns, well known in the art. Now that staples are loaded into the staple gun 1.30, the user must now load the caps 1.50 into the cap magazine 1.52. It shall be understood that the term "caps", as used herein, shall refer generally to cap washers, and preferably, caps 1.50 are plastic and are typically about the size of a U.S. quarter dollar. To load the caps into the cap magazine 1.52, the user must first stand the tool up so that the air fitting is pointing straight up into the air. The user must then pull up on the follower 1.54 which is connected to pusher 1.56 (see FIG. 4) so that pusher 1.56 travels all the way rearward, away from the nose of the staple gun and up into the top magazine door 1.58. Once this step has been performed, the user must pull straight out on the follower 1.54 so that the top door 1.58 opens. It opens by pivoting on two pins 1.60 shown in FIG. 4, thereby removing the pusher 1.56 and follower 1.54 out of the cap magazine 1.52. Now that these are out of the way the user can load the caps 1.50. The caps are collated in one of a number of ways. One preferred way of collating the caps is on so-called "weed eater" plastic line with a loop at the top. The line is pushed through the center hole of each cap (typically, 100 total) and then the bottom of the line is melted to keep the caps from falling off with a loop at the other end. To load the cap magazine 1.52 with a plurality of stacked caps 1.50 the user must pick the caps up by the loop and slide them down into the cap magazine 1.52. Once they are in all the way the user must place one finger on the top of the last cap in the stack and pull on the loop so that the weed eater line comes up and out of the center holes of the caps and is discarded (cap assembly not shown). Once the caps are in the cap magazine 1.52 and the loop/wire has been removed the user must then close the magazine door 1.58 and move follower 1.54 (and thereby also move pusher 1.56) back on top of the newly-loaded caps. The caps will then be forced toward the nose front plate 1.64 by the pulling force of the well-known constant force spring 1.66 which is attached to the follower 1.54 with a roll pin 1.68 and the nose back plate 1.70 with a bolt, as best seen in the exploded view of FIG. 4.

It will be understood that pusher means 1.56 is for pushing the plurality of stacked caps 1.50 through cap magazine 1.52 nose front plate 1.64. It will also be understood that nose front plate 1.64 and nose back plate 1.70, when assembled together, comprise a cap feeding body 1.72 having a feeding chamber 1.74 formed therewithin, with feeding chamber 1.74 having a first end 1.76 in communication with the front or first end 1.78 of cap magazine 1.52 (such that caps 1.50 enter feeding chamber 1.74 from cap magazine 1.52 through the first end 1.76 of feeding chamber 1.74) and with feeding chamber 1.74 having a second end 1.80 adjacent the nose 1.82 of gun 1.30, and caps 1.50 exit the feeding chamber 1.74 through second end 1.80 of feeding chamber 1.74.

As can be seen in FIG. 1, a cap 1.50 is shown already in place to be attached to the work surface, once the tool 1.30 is pushed down against the work surface and a staple/nail is shot from the nose of the staple/nail gun, through the already-fed cap, and into the work surface. To attach the cap to the work surface, the user must first hook the tool 1.30 to a source of compressed air and then press the tool down toward the work surface by holding the handle portion 1.34 and pushing down. As the user pushes down, compression springs 1.62 will be compressed up into the nose front plate 1.64 along with shuttle 1.84, which, through its legs 1.86, 1.88, and feet 1.90, 1.92, is connected to the rods 1.94, 1.96, and will travel upward into the nose front plate 1.64 also. This allows for the cap 1.50 and nose 1.82 of the staple gun 1.30 to come down to the work surface. The user is then able to pull the trigger 1.42 and attach the cap 1.50 to the work surface. This pushing down also allows for the next cap 1.50' in sequence (the "follower cap" to the "leading cap" previously fed) in the cap magazine 1.52 to be fed down and flipped in a manner hereinafter described.

Figure 5B:
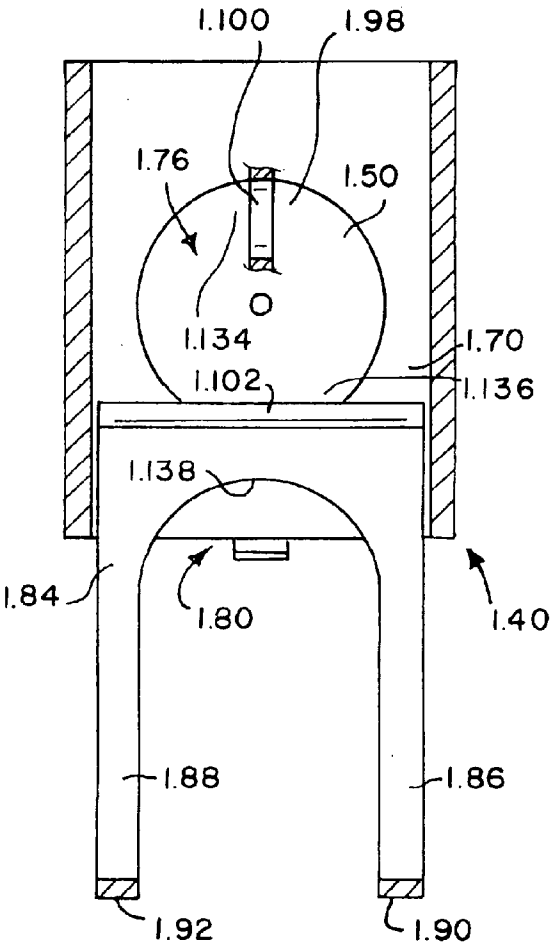
FIG. 5B is a transverse sectional view of the cap feeding apparatus taken substantially along the line 5B—5B shown in FIG. 5A.
Figure 5A:
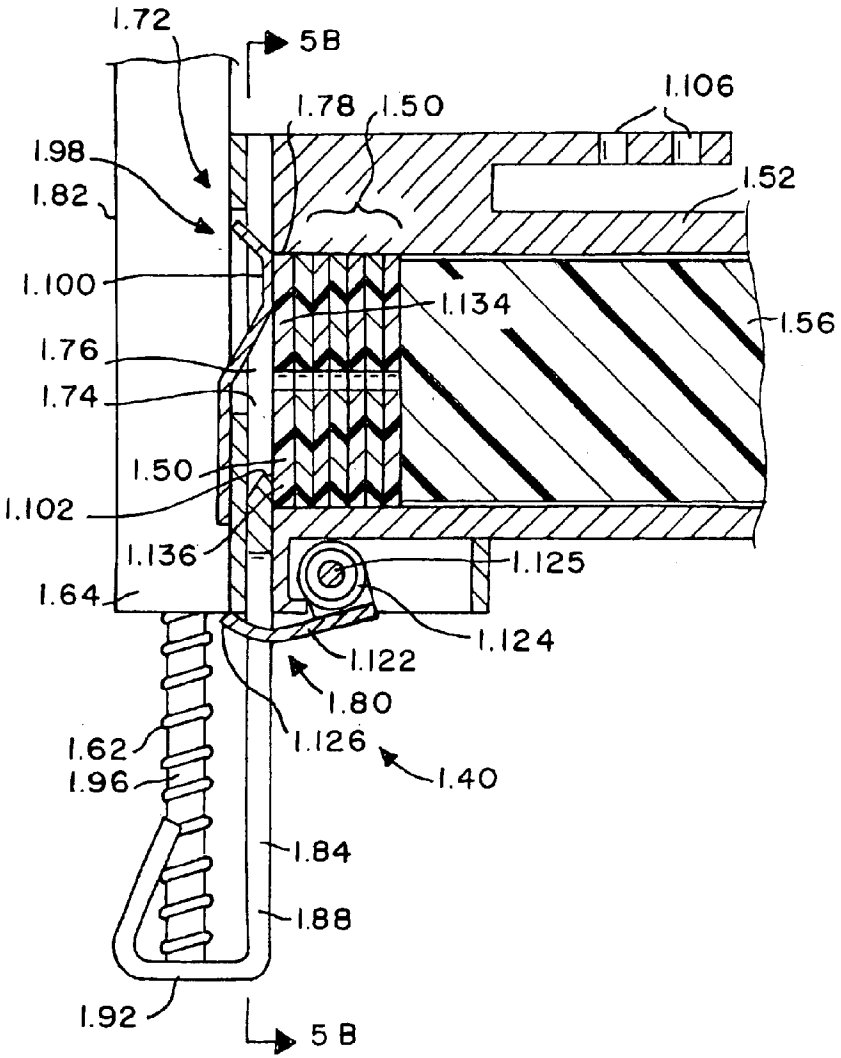

As seen best in FIG. 5A, the plurality of stacked caps 1.50 inside the cap magazine 1.52 are retained within the cap magazine by retaining means 1.98 such as spring arm 1.100 and also by the rearward edge 1.102 of shuttle 1.84. It will be seen that retaining means 1.98 is in opposition to pusher means 1.56 for opposing emergence of the magazine's leading cap 1.50 therefrom.

Figure 2:
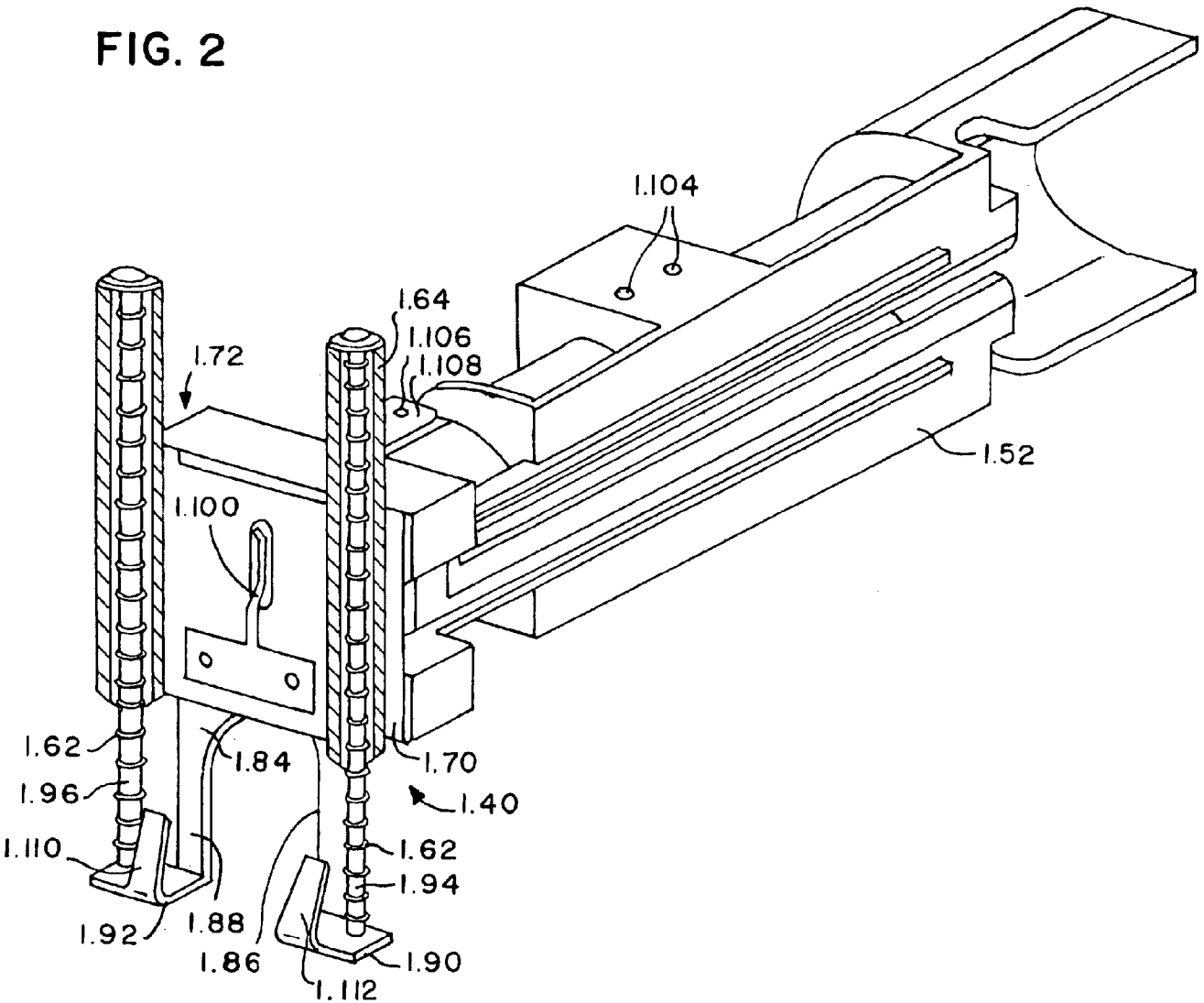
Figure 3:
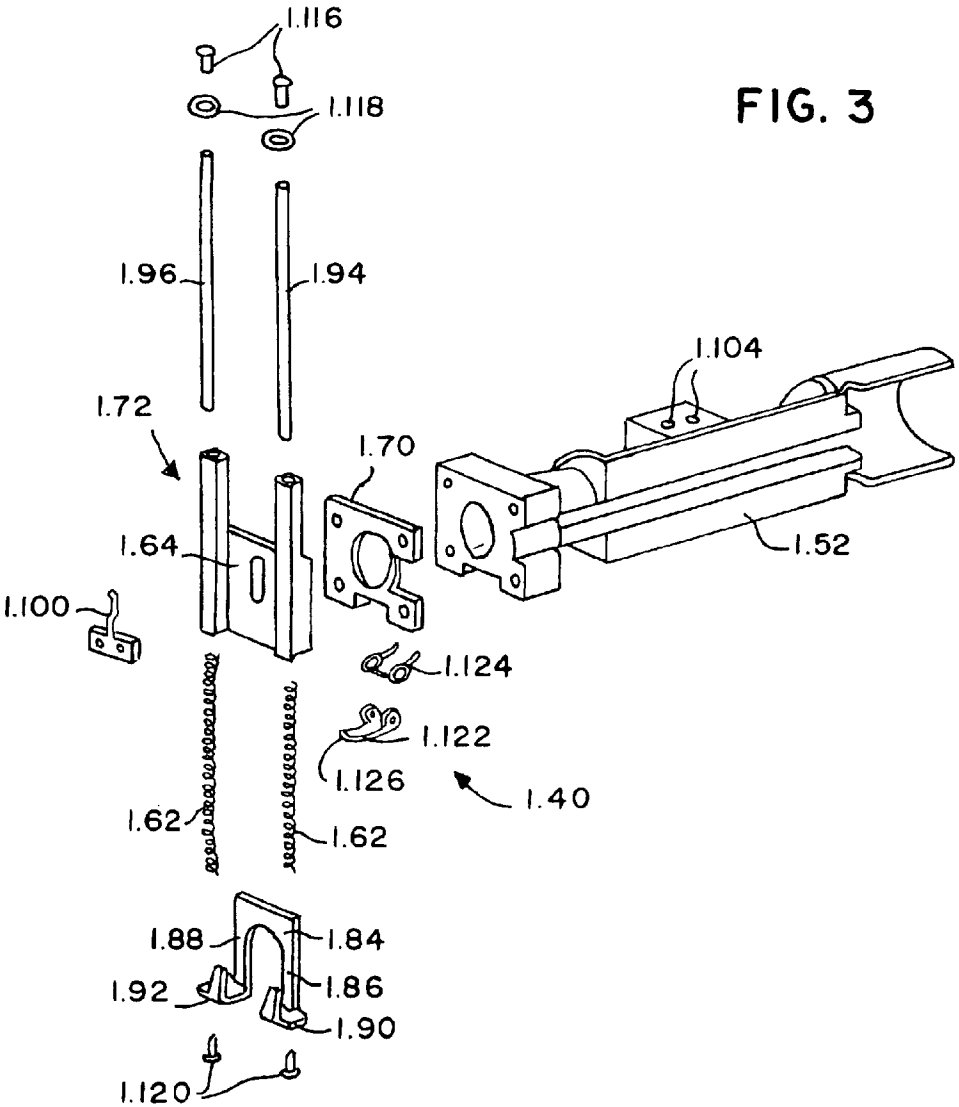
Figure 4:
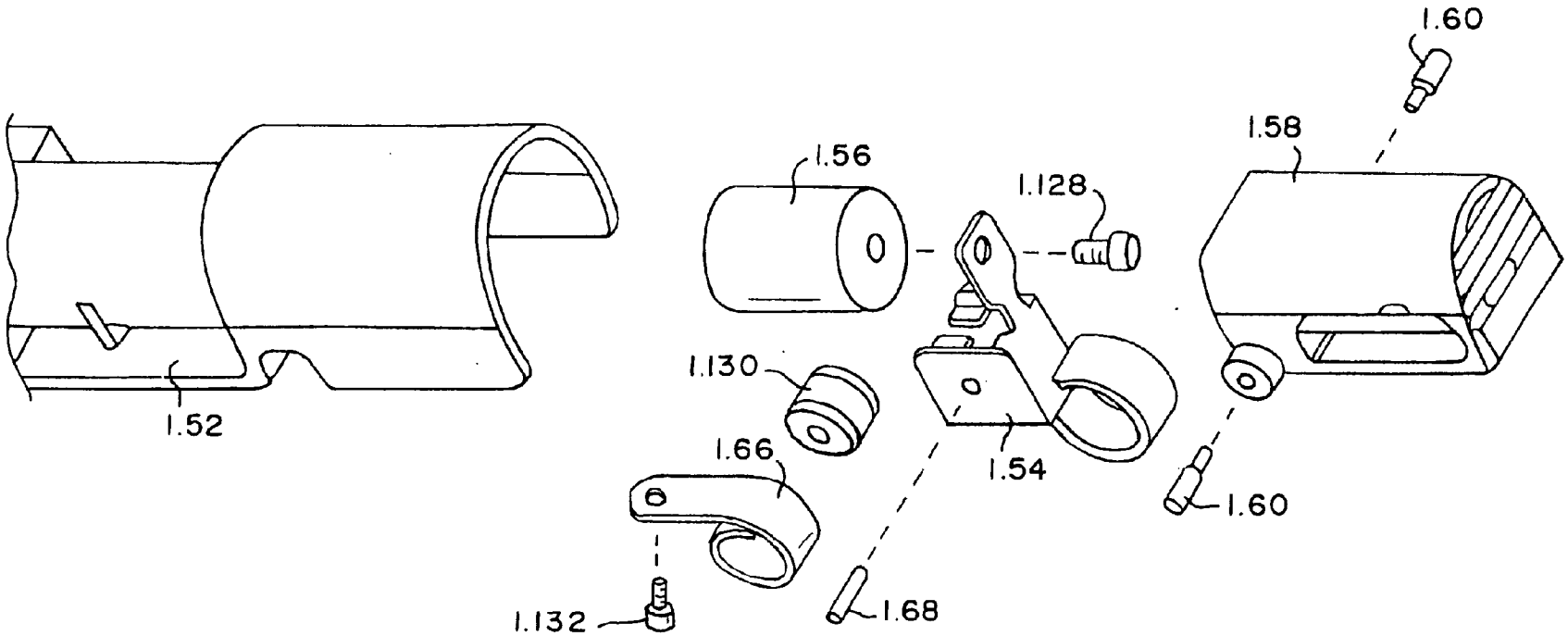

FIG. 2 shows some portions of nose front plate 1.64 removed to show the compression springs 1.62 that bias the shuttle into its cap-ejecting (or downward) position, thereby forcing the currently-fed leading cap 1.50 down and out. FIG. 2 also shows the mounting holes 1.104 in the cap magazine 1.52 and the mounting holes 1.106 in the top bracket 1.108. These mounting holes 1.106, 1.104 are used to mount the staple gun 1.30 to the cap magazine 1.52 and thereby to cap feeding apparatus 1.40. FIGS. 2 through 4 show the various parts of the cap feeding apparatus 1.40.

The shuttle 1.84 has two angled arms 1.110, 1.112 that can engage the outside edges of the cap 1.50 when the shuttle is in the cap-receiving (upward) position so as to align the already-fed cap substantially perfectly under the nose 1.82 of the staple/nail gun 1.30. This happens as the shuttle 1.84 is traveling up into the cap feeding body 1.72, when the rearward edge 1.102 of shuttle 1.84 is within shuttle track portion 1.114, as best seen in FIG. 10A. A cap 1.50 has already been flipped out under the nose 1.82 of the tool 1.30 and the tool 1.30 is being pressed downward to apply that cap 1.50. As the tool 1.30 is pressed down, the rearward edge 1.102 of shuttle 1.84 comes up into its track portion 1.114, and, as it does this, angled arms 1.110, 1.112 come up along the side edges of the cap 1.50 and align the cap under the nose 1.84. It should be noted that shuttle 1.84 also releases a safety (not shown, but well-known to those skilled in the art) for tool 1.30 when fully upward as shown in FIG. 10A, thereby preventing firing of the fastener gun unless the nose of the gun is adjacent the workpiece surface S.

FIGS. 3 and 4 are exploded views from the left side of the feeding system for the plastic caps. The staple gun is not included in these views. Some parts that have not been pre are as follows: rod bolts and washers 1.116, 1.118; bottom rod bolts 1.120, flipper arm 1.122, flipper arm spring 1.124, and flipper arm roll pin 1.125. As best seen in FIGS. 5A through 10A, flipper arm 1.122 is mounted to cap feeding body 1.72 for pivoting about the axis of roll pin 1.125, and the distal end 1.126 of flipper arm 1.122 is biased upwardly by flipper arm spring 1.124 so as to engage fed caps as they emerge, as hereinafter described.

FIG. 4 is an exploded view of the cap pusher means at the back part of the cap magazine 1.52 where the magazine door 1.58 can be opened and the pusher assembly moved out of the way to allow the plurality of stacked caps to be inserted into the cap magazine 1.52. The magazine loading door 1.58 pivots about a pair of hinge pins 1.60. A bolt 1.128 secures follower 1.54 to pusher 1.56. Follower spring 1.66 is mounted about spring drum 1.130 which, in turn, is mounted for rotation about roll pin 1.68, which retains spring drum 1.130 within follower 1.54. A bolt 1.132 secures the end of follower spring 1.66 to cap magazine 1.52 as best seen in FIG. 1.

FIG. 5A is a longitudinal sectional view of the cap feeding apparatus in the region of the nose 1.82 of fastener gun 1.30. It is showing a plurality of stacked caps loaded in the cap magazine 1.52 and the shuttle 1.84 in the cap-receiving (upward) position ready to be pushed down so that a cap can be fed out and applied to the work surface. This is the first position that the tool will always be in once the caps have been loaded. As can be seen from this drawing, the caps 1.50 in the cap magazine 1.52 are held back from entering the shuttle track area 1.114 of the feeding chamber 1.74. It will be noted that the caps 1.50 are held back by two things, one being the spring arm 1.100 engaging the trailing (top) portion 1.134 of the leading cap 1.50, and the other being the rearward edge 1.102 of the shuttle retaining the leading (bottom) portion 1.136 of leading cap 1.50. This is very important because if the caps 1.50 were allowed to enter this track area 1.114 of the feeding chamber 1.74 before the shuttle was in the cap-receiving position (i.e., upward), a cap 1.50 would become jammed up into the bottom of the staple gun magazine (not shown). It should also be noted that the pusher 1.56 is pushing the caps down the cap magazine toward the nose of the fastener gun.

Figure 6B:
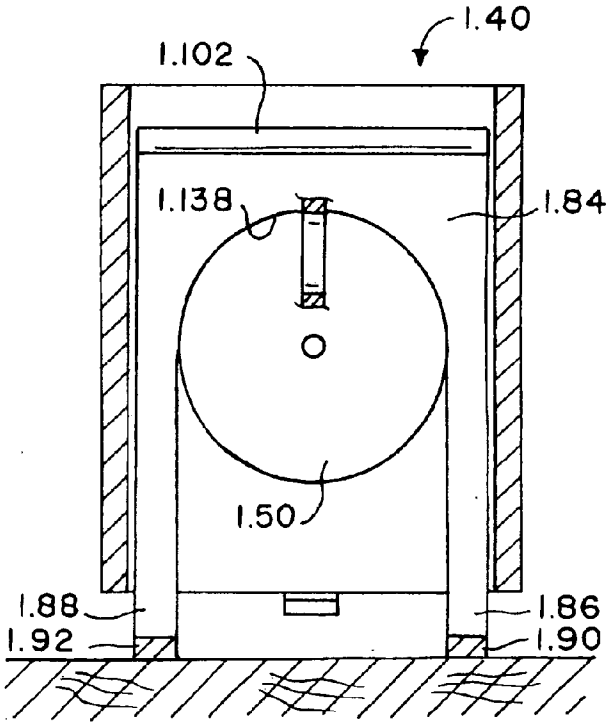
FIG. 6B is a transverse sectional view of the cap feeding apparatus taken substantially along the line 6B—6B shown in FIG. 6A.
Figure 6A:
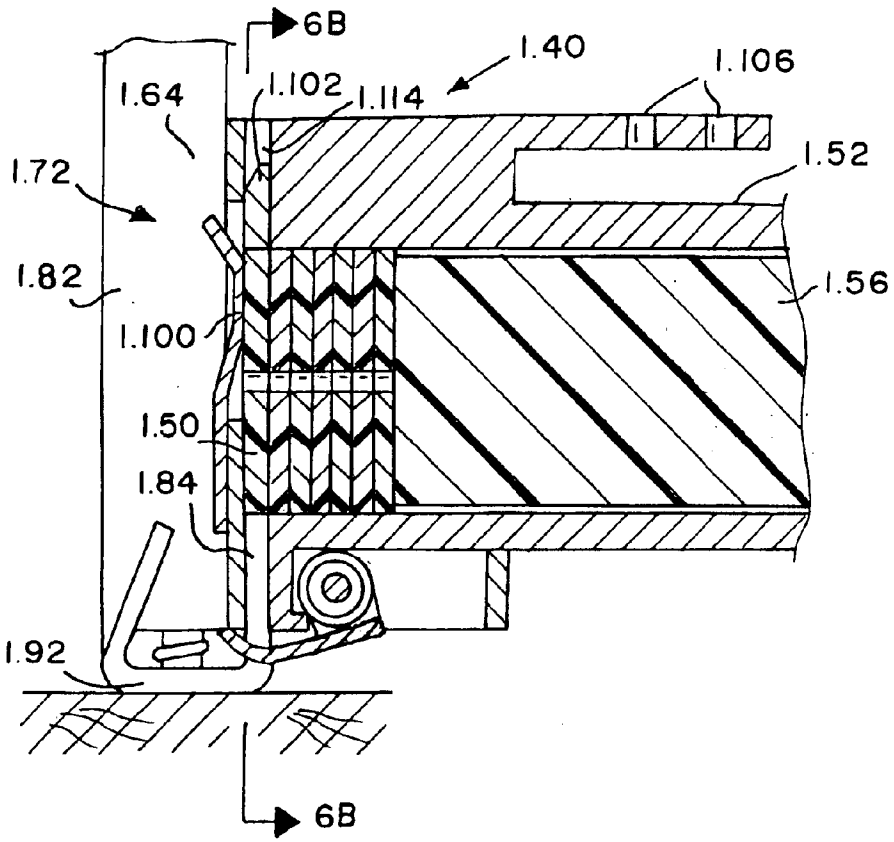
FIG. 6A is a longitudinal sectional view similar to FIG. 5A, except with the shuttle being moved into the cap-receiving position as the shuttle's feet are pressed against the workpiece surface, and with the leading cap having just been pushed from the cap magazine so that it is now immediately below the forward edge of the shuttle.

FIG. 6A is a cross section of the same area as FIG. 5A but is showing that the shuttle has been pushed upward into the cap receiving position. It should be noted that the spring arm 1.100 has been pushed out of the track area 1.114 by the beveled rearward edge 1.102 of the shuttle 1.84, and the rearward edge of the shuttle has now become interposed between the spring arm 1.100 and the leading cap 1.50. The forward edge 1.138 of shuttle 1.84 is preferably downwardly concave for best engagement with the leading cap 1.50 during the downward stroke and, in the first embodiment of the present invention, the forward edge 1.138 of the shuttle is generally downwardly "U" shaped. When the shuttle is in the cap-receiving position (upward) as shown in FIGS. 6A and 6B, the leading cap can and does emerge from the cap magazine 1.52 in response to urging by the pusher 1.56, and moves into substantial coplanar relationship with the shuttle, forward of the shuttle's forward edge.

Figure 7B:
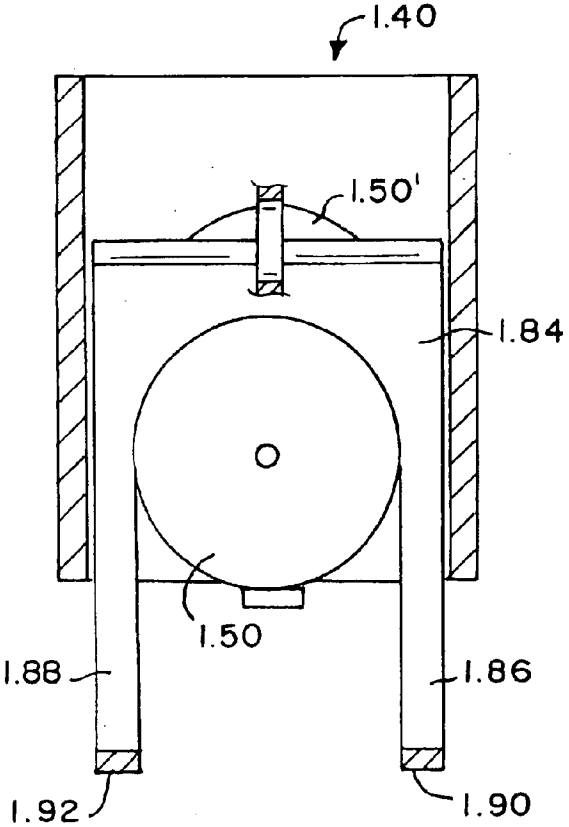
FIG. 7B is a transverse sectional view of the cap feeding apparatus taken substantially along the line 7B—7B shown in FIG. 7A.
Figure 7A:
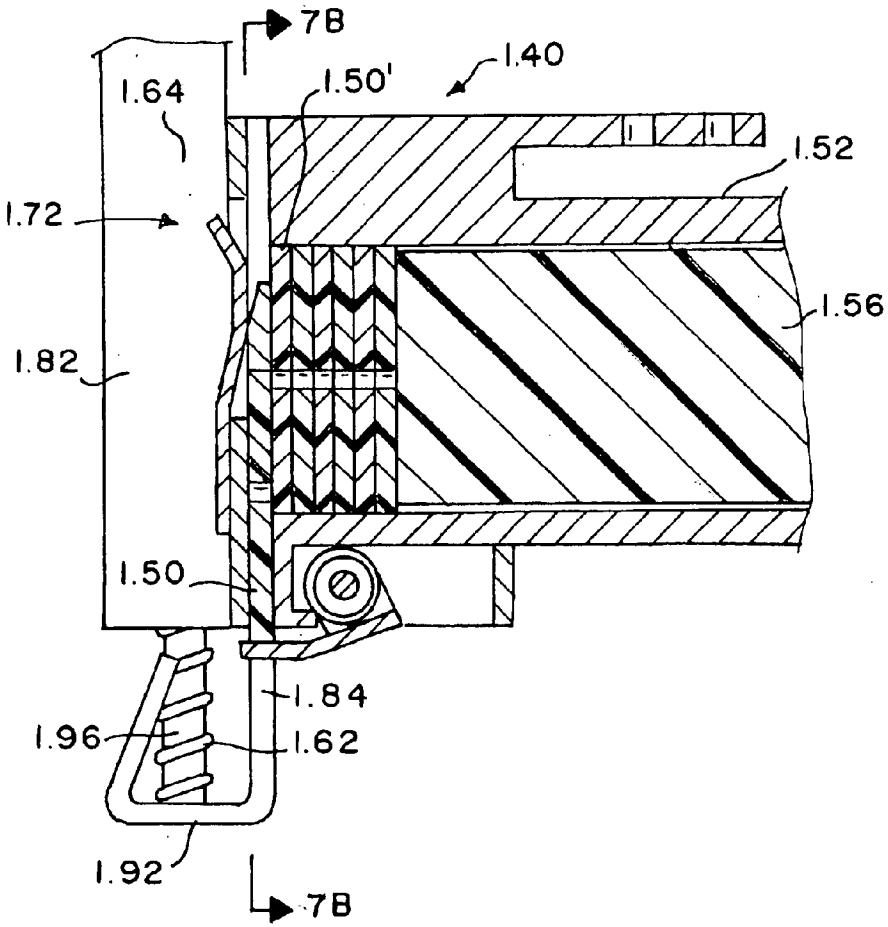
FIG. 7A is a longitudinal sectional view similar to FIG. 6A, except with the shuttle being moved downward from the cap-receiving position as the fastener gun is raised from the workpiece surface. The leading cap is being forced along the feed path by the forward edge of the shuttle and is beginning to engage the flipper arm.

FIG. 7A is also a cross-section of the front area of the nose 1.82 of the tool. FIGS. 7A and 7B show how the leading cap 1.50 has begun to travel downward and is starting to push against and be engaged by the flipper arm 1.122. The spring arm 1.100 is also shown being allowed to begin to come back into the track area 1.114 to keep the next cap in sequence (the "follower cap" 1.50' to the leading cap 1.50 just fed) retained within the cap magazine 1.52.

Figure 8B:
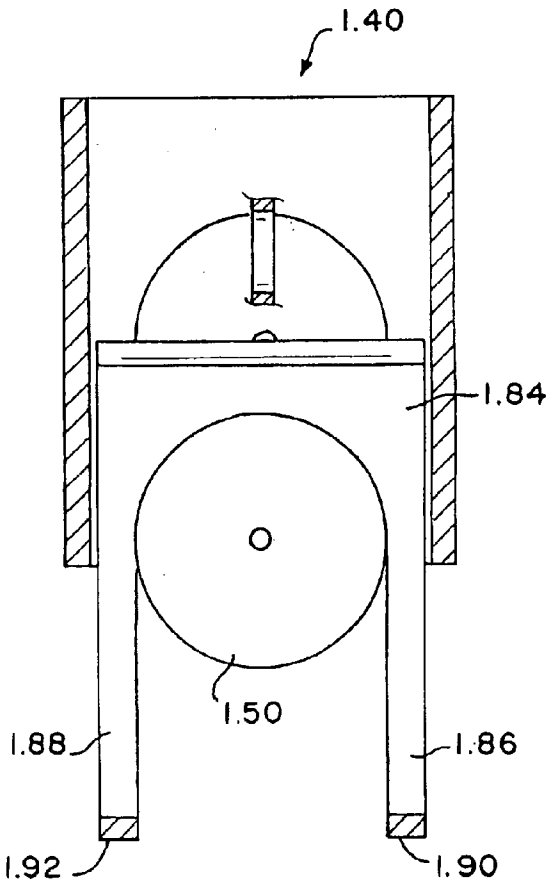
FIG. 8B is a transverse sectional view of the cap feeding apparatus taken substantially along the line 8B—8B shown in FIG. 8A.
Figure 8A:
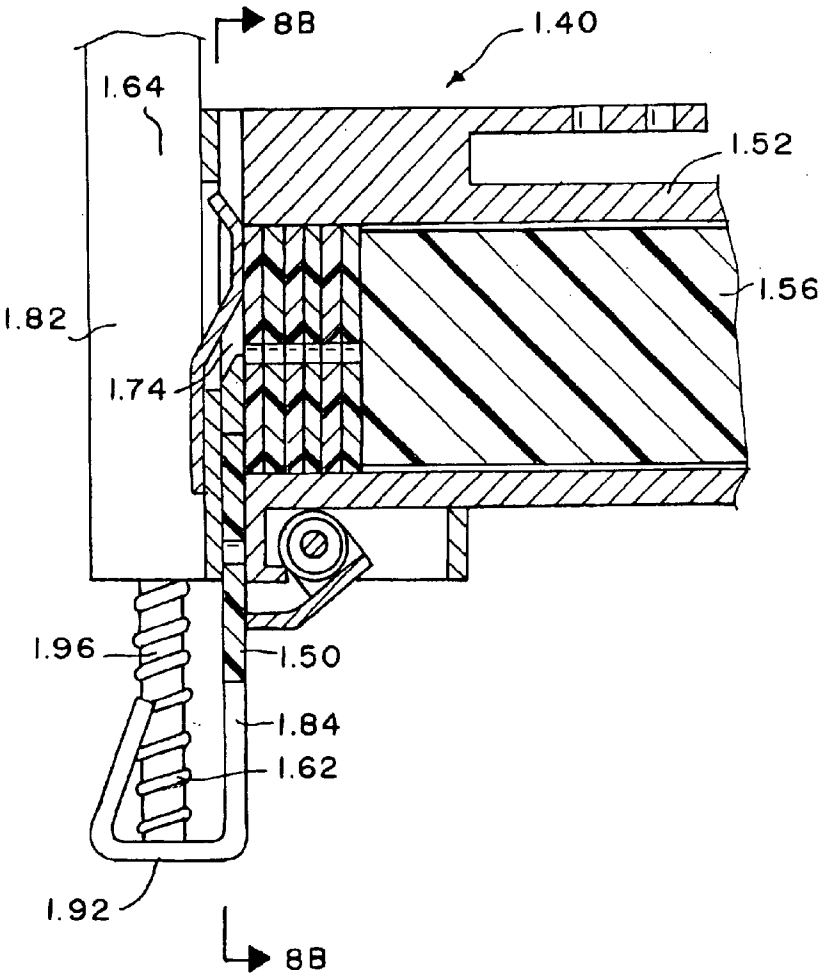
FIG. 8A is a longitudinal sectional view similar to FIG. 7A, except with the shuttle being moved further downward and showing the flipper arm now engaging the back of the emerging leading cap.

FIGS. 8A and 8B are the next time progression from FIGS. 7A and 7B but show that the spring arm 1.100 is holding the trailing portion of the follower cap 1.50' in the cap magazine 1.52 and preventing the follower cap 1.50' from entering the feeding chamber. It will be noted that the flipper arm 1.122 has been pushed out of the way and the flipper arm spring 1.124 is applying pressure to the flipper arm 1.122 against the back of cap 1.50 to cause cap 1.50 to be flipped about an axis transverse to the feed direction, preferably ninety degrees of flip as shown by comparison of FIGS. 8A–8B with FIGS. 9A–9B.

Figure 9B:
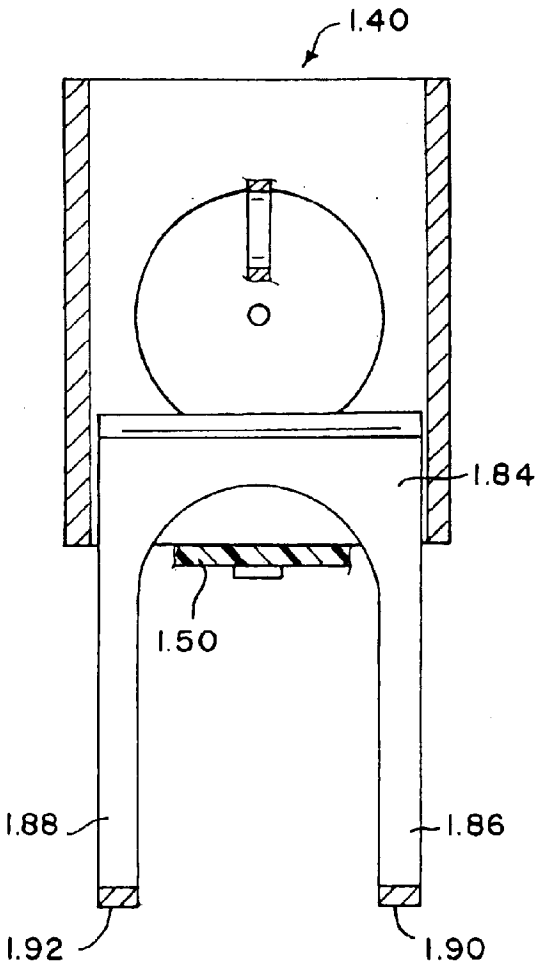
FIG. 9B is a transverse sectional view of the cap feeding apparatus taken substantially along the line 9B—9B shown in FIG. 9A.
Figure 9A:
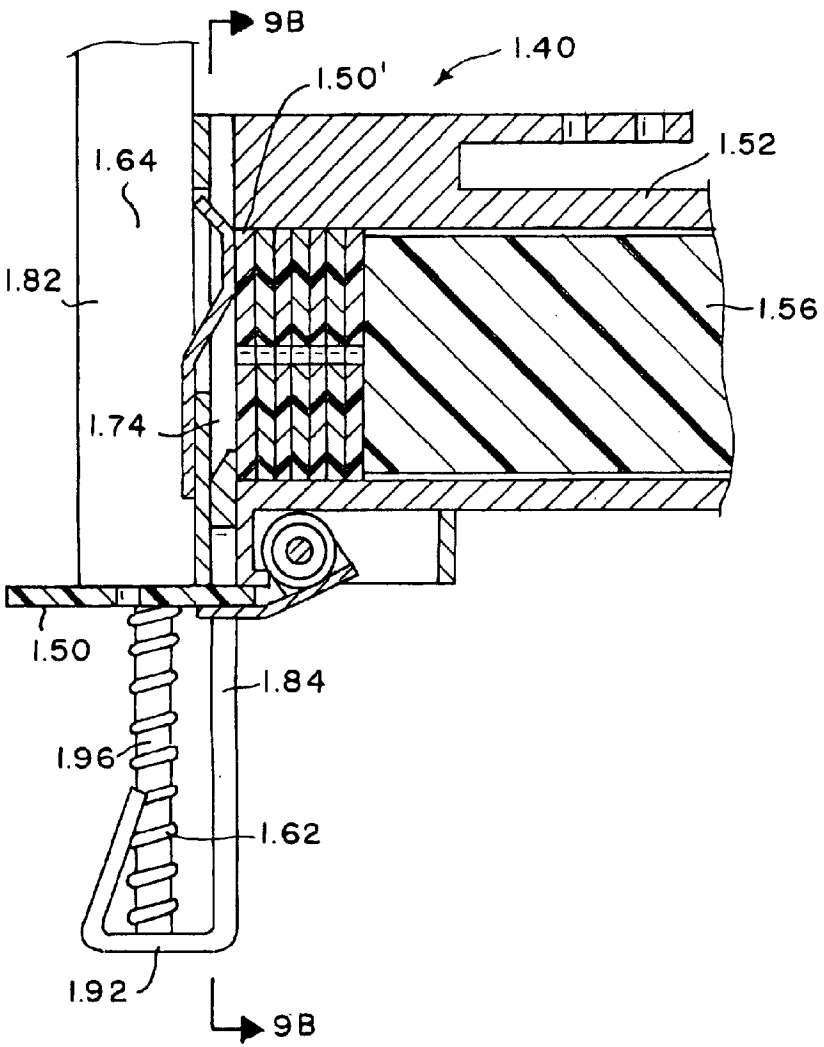
FIG. 9A is a longitudinal sectional view similar to FIG. 8A, except with the shuttle now in the cap-ejecting position and at the end of its stroke, showing the flipper arm pinching the trailing portion of the leading cap to the cap feeding body and holding the leading cap in position for receiving a fastener from the fastener gun.

FIGS. 9A and 9B are the next time progression from FIGS. 8A and 8B and now show that the cap 1.50 has been flipped and is ready to be shot to the work surface by a staple/nail gun. It also shows that the spring arm 1.100 is holding the trailing portion of the new leading cap 1.50' in the cap magazine, and the rearward edge 1.102 of the shuttle 1.84 is holding the leading portion of the new leading cap 1.50' in the cap magazine 1.52 from coming out into the feeding chamber. This also shows that the flipper arm 1.122 holds the previously-fed cap 1.50 in place until the tool 1.30 is pushed down and the cap 1.50 is shot to the work surface.

Figure 10B:
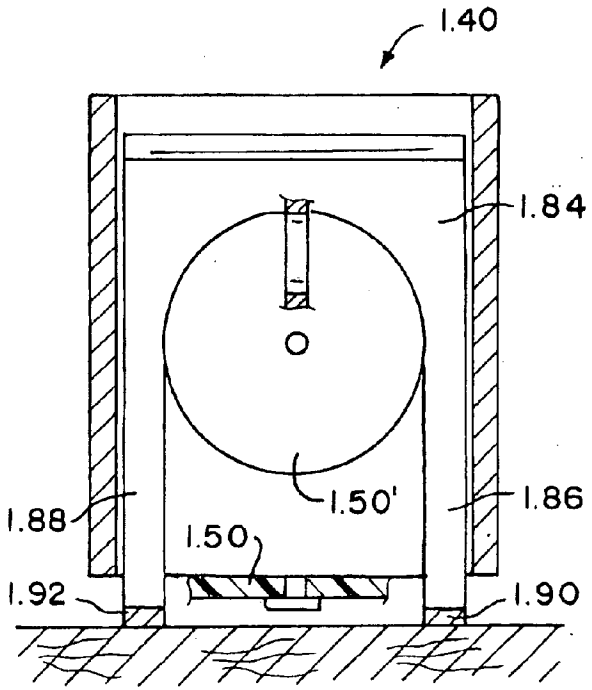
Figure 10A:
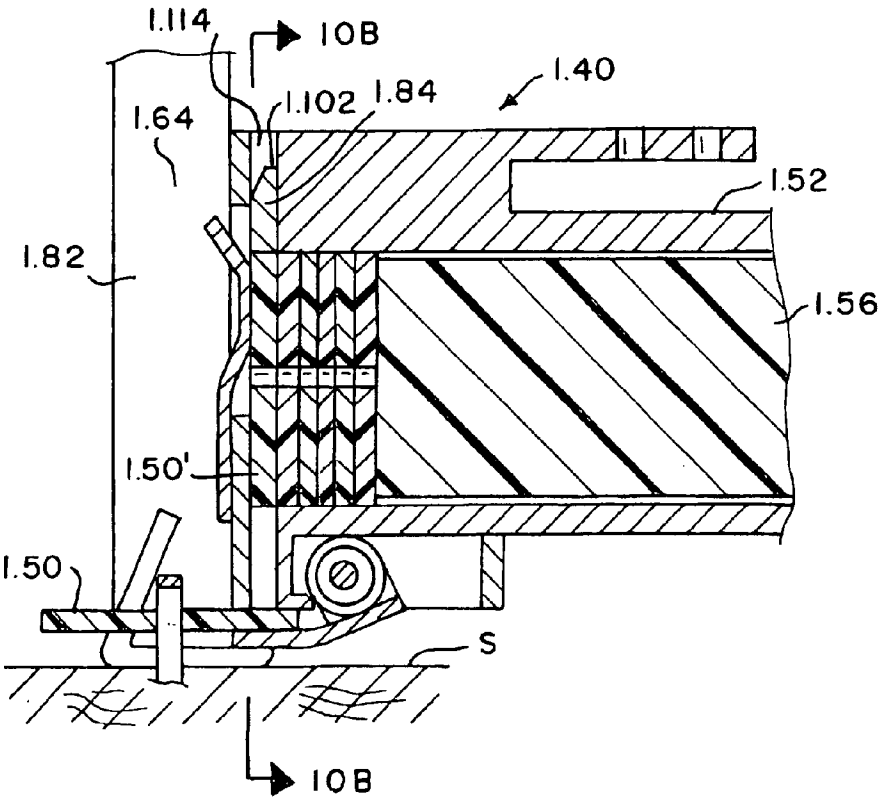
FIG. 10A is a longitudinal sectional view similar to FIG. 6A except that a cap has been fed into position and a fastener is now being driven through the cap as the fastener gun is pressed against the workpiece surface, causing the legs of the shuttle to again move the shuttle into the cap-receiving position for the next cycle.

FIGS. 10A and 10B are the next time progression with the tool 1.30 having been pushed down to staple/nail the previously-fed cap to the work surface, with the previously-fed cap now being shot to the work surface. The cycle repeats as before.

Referring to drawing FIGS. 11 through 16, an improved second embodiment of the present invention, namely, a cap feeding system for a bottom-load staple gun, will now be described in detail. Because there are many similarities with the first embodiment, only the differences will be described in detail, it being understood that similar structural features perform similar functions in the same way in both embodiments.

Another way to make this tool without compromising the weight and balance of it is to add an air cylinder to operate the shuttle that feeds the caps down and flips them sideways. By doing this the operator of the tool does not have to manually push down to compress the springs that are attached to the shuttle which then pulls the cap down and flips it sideways as described in the first embodiment. This makes for a less strenuous operation of the tool. The air cylinder is mounted on the side of the body of the tool, it is a spring feed and air returned air cylinder. What this means is that every time the air tool is fired air is applied to the underside of the piston of the air cylinder. This causes the air cylinder shaft 2.190 of the air cylinder 2.194 to retract up into the cylinder, as it retracts upward it pulls the shuttle 2.84 up to allow another cap 2.50 to be fed down and out. Once the piston of the air cylinder has reached the top of it's stroke a spring pushes the piston back down. So the long and short of it is, air pushes the piston up and a spring pushes it back down. This could also be done with an air cylinder that is air fed and air returned.

The main difference between the first embodiment and the second is what makes the shuttle operate. In the first embodiment two springs are compressed allowing the shuttle to go up and then they force it back down. In the second embodiment an air cylinder causes the shuttle to reciprocate. Because FIGS. 11 through 16 are of a tool that is a bottom-load staple gun and because the air cylinder 2.194 needs to be attached to the housing of the air tool 2.30, the shuttle 2.84 and the shaft of the air cylinder 2.190 must separate when loading staples into the air tool 2.30. Please note that this is not the case if the tool is not a bottom-load staple gun. Please see FIGS. 17 through 20 to see how an air cylinder that is an air feed/air return is mounted on a tool that is not a bottom-load tool. In this case the shuttle and the air cylinder shaft can stay connected at all times. This will be discussed in full in the coming paragraphs.

Figure 11:
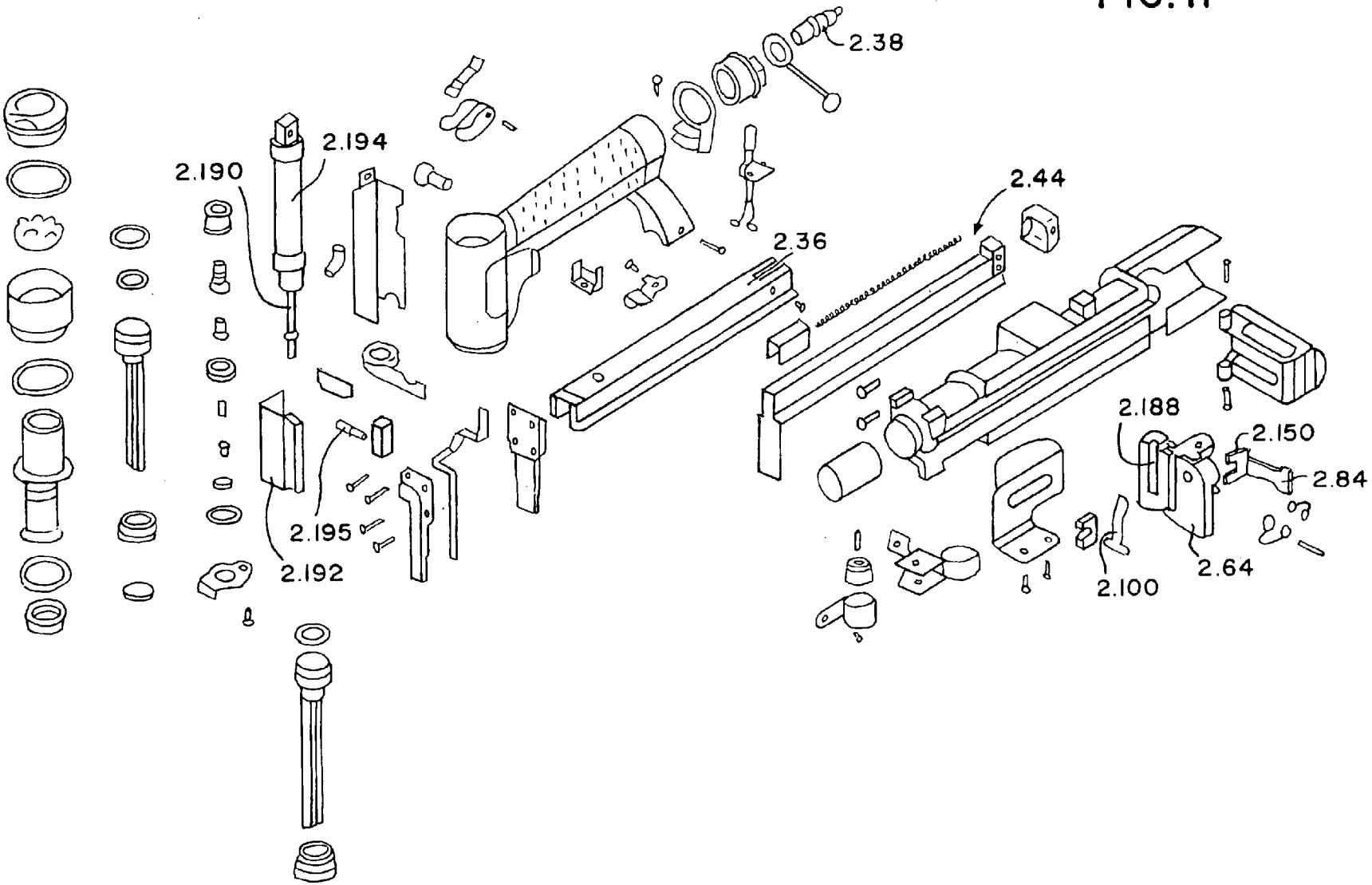
FIGS. 11 through 16 show a second embodiment of the present invention.

FIG. 11 is an exploded view of the staple gun and the plastic cap feeding system that is integrated onto it. It shows all the parts and how they assemble together.

A suitable fastener gun 2.30 for use with the second embodiment is, like the first embodiment, a well-known so-called "80-Series" staple/nail gun. As with the first embodiment, one such staple/nail gun that is suitable for use with the second embodiment of the present invention is a model number S80/16 LN-A1 staple gun made and sold by Basso Corp., NO.24 36th Rd., Taichung Ind. Park, Taichung, Taiwan, R.O.C.

Figure 12:
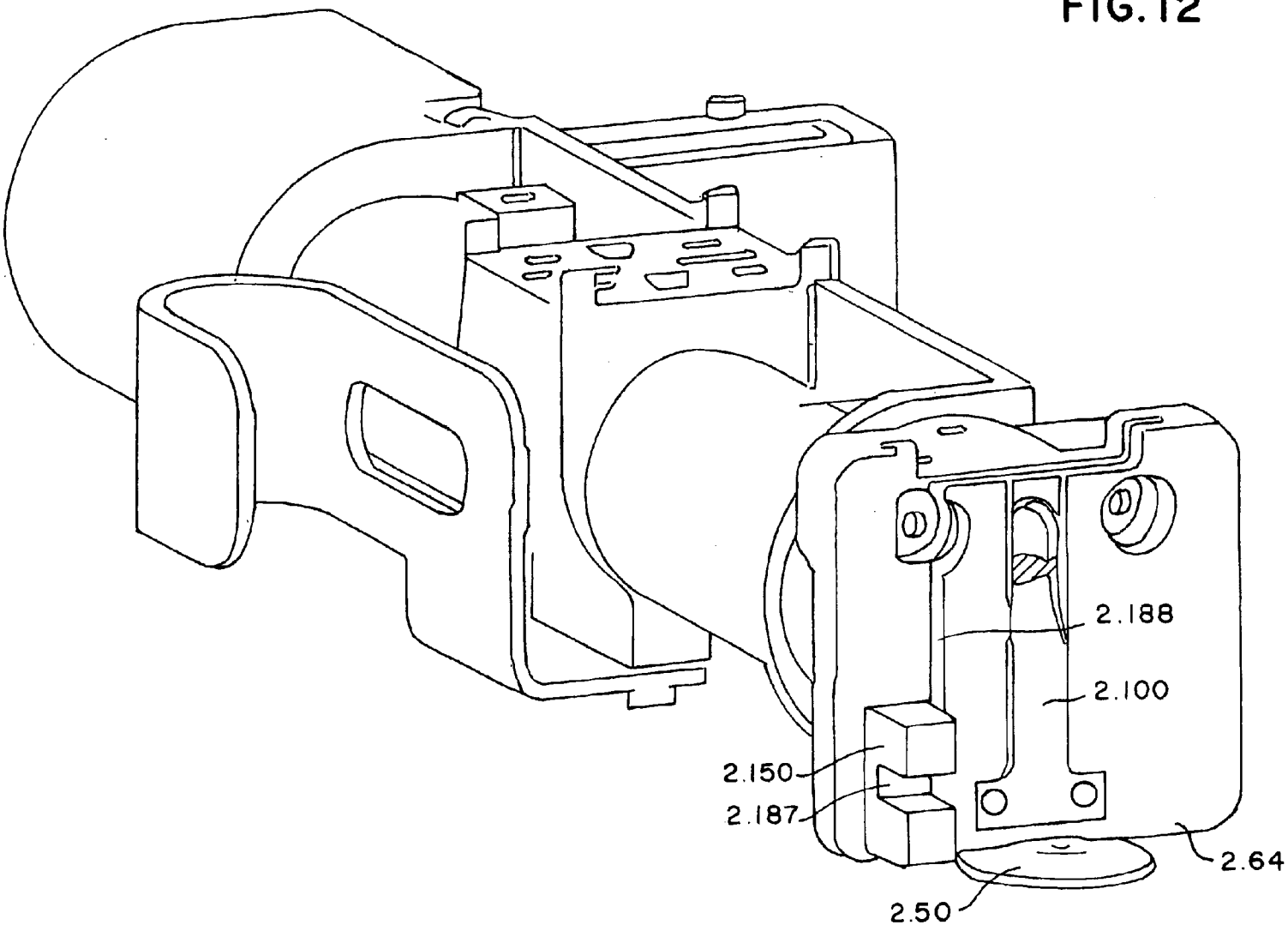
Figure 13:
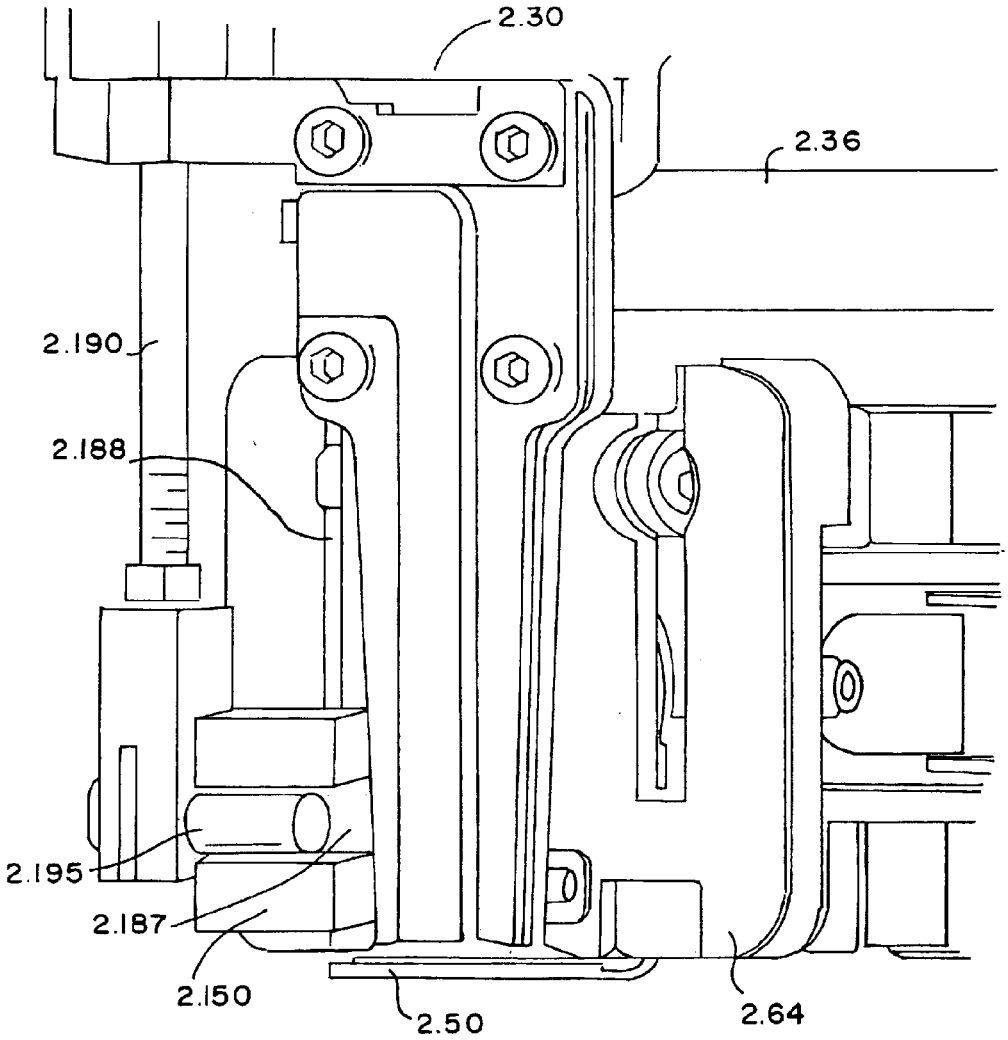
Figure 14:
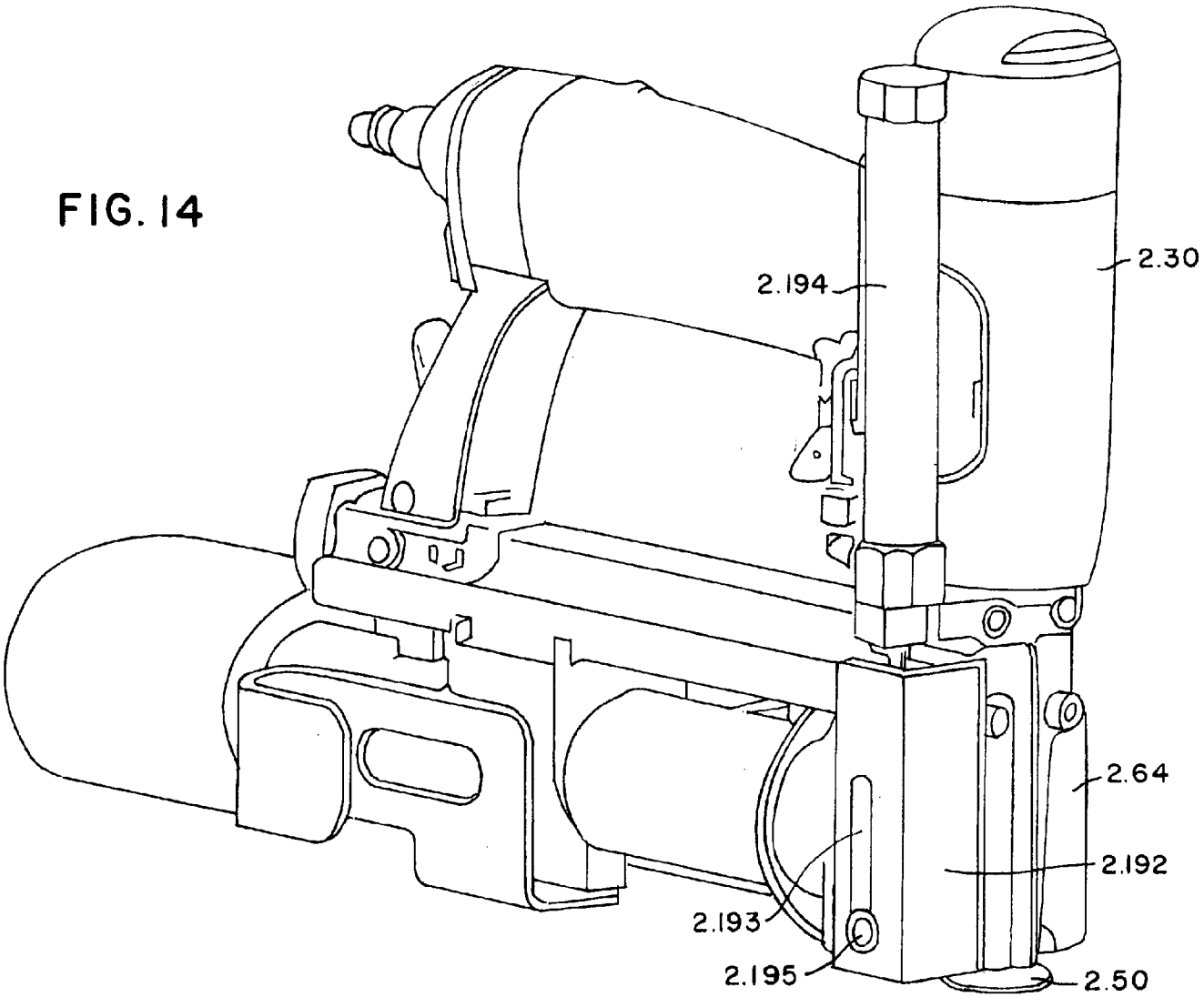

FIG. 12 is a front view of the cap feeding system for a bottom-load staple gun 2.30 (see FIG. 14). The air cylinder 2.194 is not shown because it is mounted on the staple gun 2.30 itself. It also shows a shuttle 2.84 and how it has an open slot or notch 2.187 to receive the actuator drive pin 2.195 (see FIG. 13). This drawing also shows that the nose front plate 2.64 has been changed and no longer has the two areas that house the compression springs 1.62 as described in the first embodiment. The nose front plate 2.64 has also been changed and had a shuttle arm slot 2.188 cut in it to allow an arm 2.150 of the shuttle 2.84 to extend out through the nose front plate 2.64. This allows the shuttle 2.84 to be moved up and down by the air cylinder, thereby retrieving a succession of caps 2.50 to feed down and out.

FIG. 13 is a front view of the cap feeding system with a bottom-load staple gun 2.30 mounted on it. The air cylinder cover/guide 2.192 (see FIG. 14) has been removed so as to show how the actuator drive pin 2.195 aligns and fits right into notch 2.187 when the staple gun outer magazine 2.36 has been closed.

FIG. 14 is a front side view of the complete assembly of the cap feeding system with the bottom-load staple gun 2.30 mounted on it. It is showing the air cylinder cover/guide 2.192 with a groove 2.193 cut into the side of it. It is also showing the actuator drive pin 2.195 protruding out of the groove 2.193 which it uses as a guide. The reason this cover/guide 2.192 is needed is so the actuator drive pin 2.195 will align back up with the notch 2.187 in the shuttle 2.84 when you finish loading staples into the outer magazine 2.36 and you close it.

Figure 15:
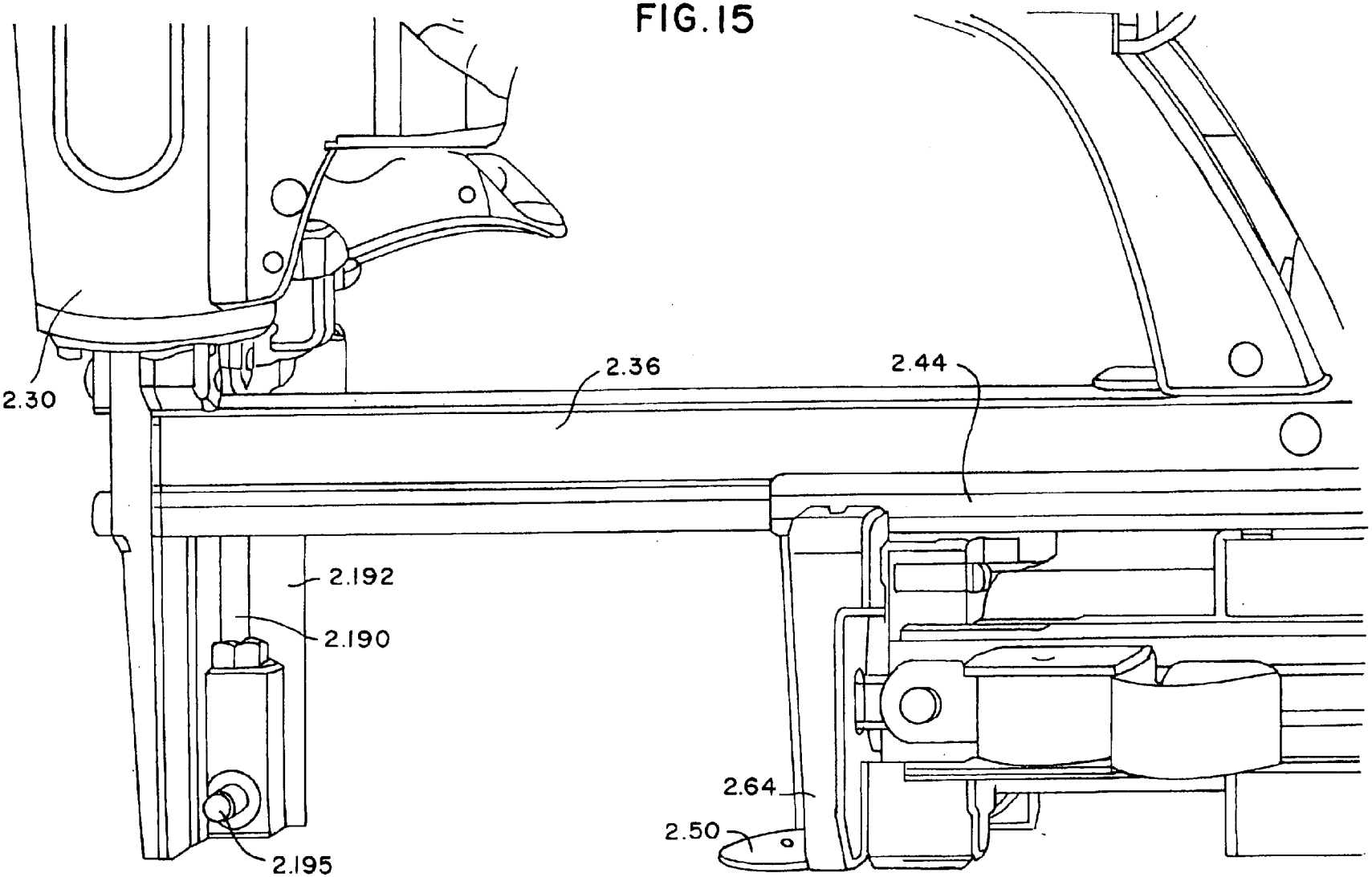

FIG. 15 is a right side view of the staple gun being opened to load staples into the outer magazine 2.36. You can also see how the actuator drive pin 2.195 has separated from the shuttle notch 2.187 (see FIG. 12) and how the air cylinder cover/guide 2.192 is holding the air cylinder shaft 2.190 and the actuator drive pin 2.195 in place so that when the staple magazine is closed the shuttle notch 2.187 and the actuator drive pin 2.195 will line back up and receive each other. The reason it stays in place is because the actuator drive pin 2.195 protrudes out through the groove 2.193 (see FIG. 14).

Figure 16:
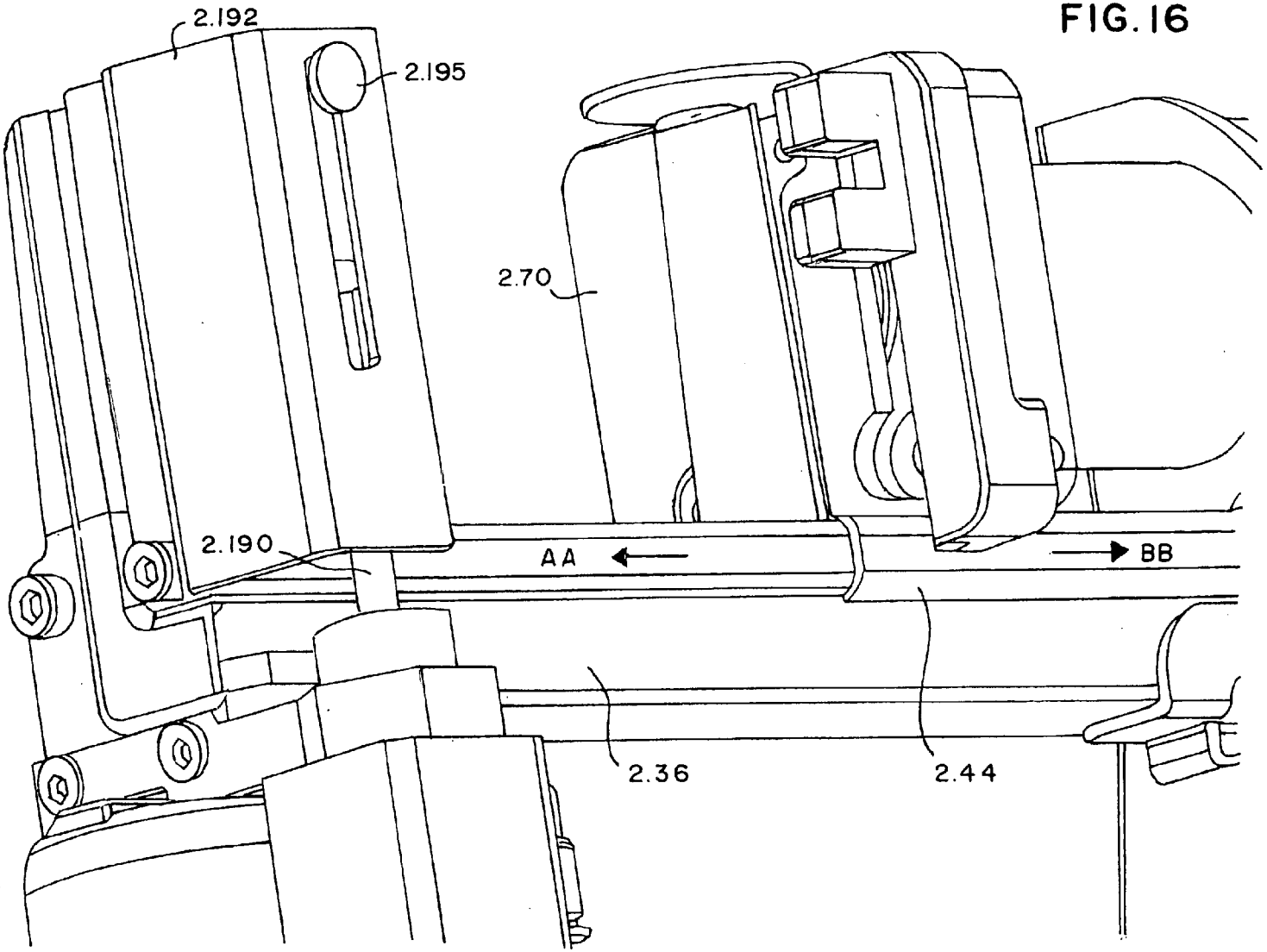

FIG. 16 is a side view of the complete assembly of the cap feeding system with the bottom-load staple gun mounted on it. This drawing is showing the tool in the up side down position. This is how the tool would be when you are loading staples into the outer magazine 2.36. It is also showing the arrow AA as being the outer magazine 2.36 and the arrow BB as being the inner magazine 2.81. This shows the direction that the two magazine parts would go in when you open them to load staples.

FIGS. 17 through 20 show a third embodiment of the present invention, namely, a cap feeding system for a top-load pneumatic coil nail gun 3.30, with differences from the second embodiment now being described.

Figure 17:
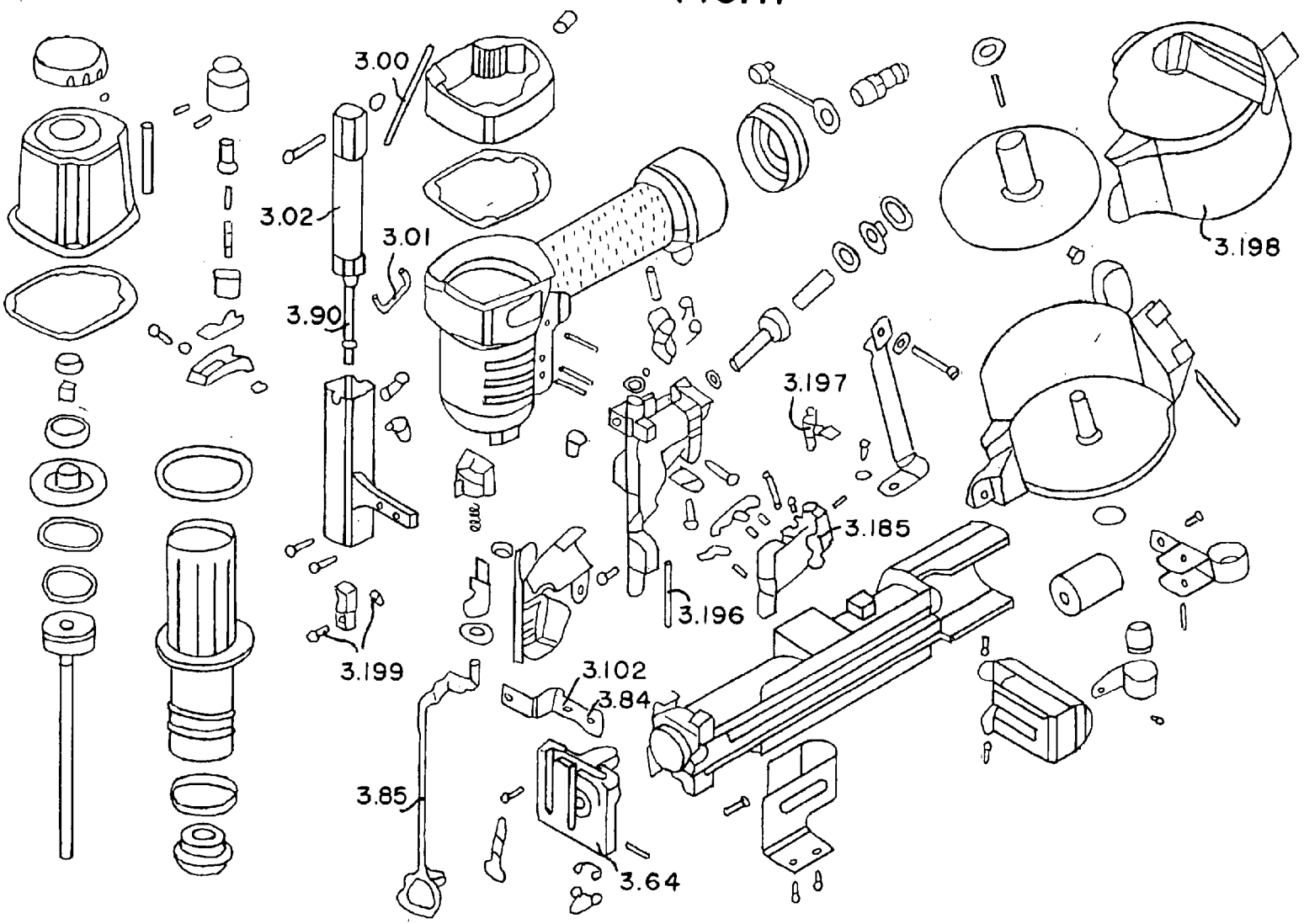
FIGS. 17 through 20 show a third embodiment of the present invention.

FIG. 17 is an exploded view of a coil nail gun and the plastic cap feeding system that is integrated onto it.

A suitable top-load pneumatic coil nail gun 3.30 for use with the third embodiment is a model number C21/50 LN-A1 coil nail gun made and sold by Basso Corp., NO.24 36th Rd., Taichung Ind. Park, Taichung, Taiwan, R.O.C.

Figure 18:
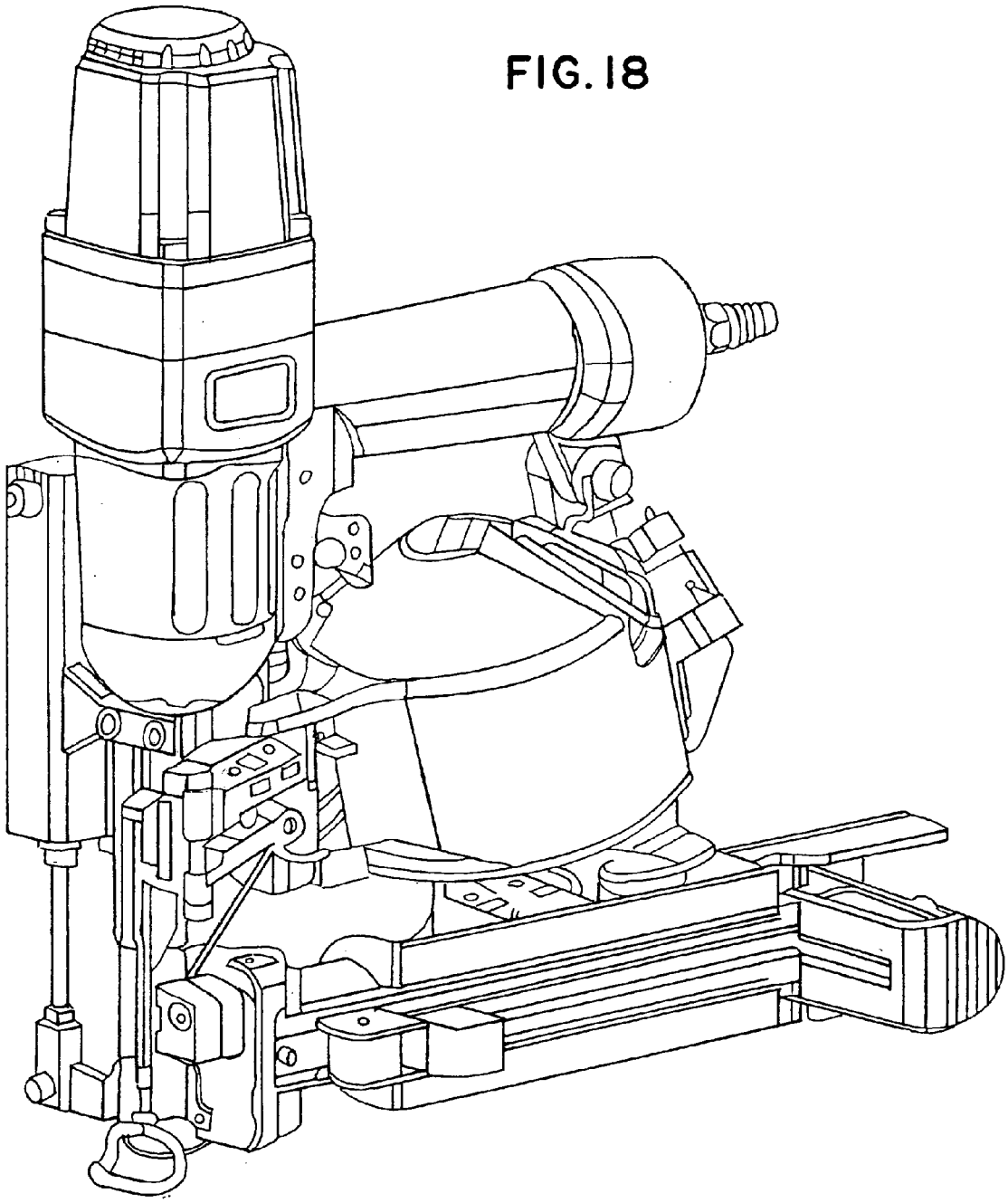

FIG. 18 is a front side view of the cap feeding system mounted on a pneumatic coil nail gun 3.30 that is not a bottom-load tool 2.30 (see FIG. 14). It is a top-load tool. This also shows how the shuttle 3.84 does not need to separate from the air cylinder shaft 3.190. It shows how a bolt 3.199 and nut keep these two items connected at all times. To load this tool with nails you would push down on the door latch 3.197 which would pivot open on the door hinge pin 3.196 this in turn would allow you to open the back magazine cover 3.198. Once this has been done you would install the coil nails into the magazine and feed them into the nose and then close the nose door 3.185.

Figure 19:
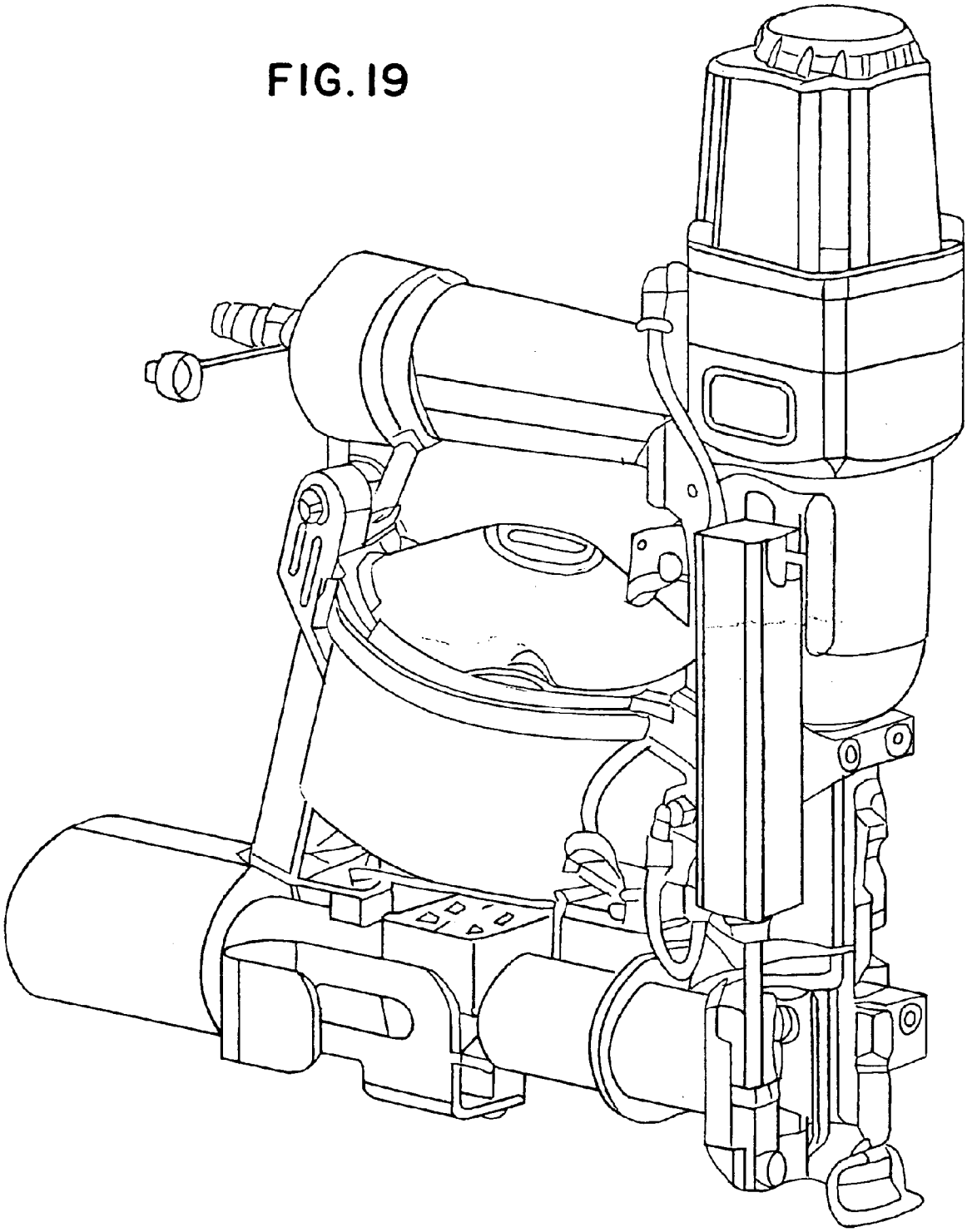

FIG. 19 is a back side view of the cap feeding system mounted on a pneumatic coil nail gun 3.30. It is showing how a air-feed air-return 3.194 air cylinder is used and operates by using the different air chambers of the coil nailer. When air is applied to the air plug 3.82 of the tool, air enters the air cylinder feed line 3.00. This applies air to the top of the air cylinder 3.194 piston causing the air cylinder shaft 3.190 to be forced downward. This ensures that a cap 3.50 is ready to be attached to the work surface. To attach a cap you must push the area of the tool closest to the nose front plate 3.64 down. This will push the safety 3.85 up making contact with the trigger 3.42. Once you have done this you can pull up on the trigger 3.42 which will fire the nail gun. When you pull the trigger 3.42 this will release the air that is in the air-feed cylinder line 3.00 and will apply air to the air cylinder return line 3.01 causing the shuttle 3.84 to retract and pick up another cap 3.50 and feed it down and out once the tool is picked up from the work surface.

Figure 20:
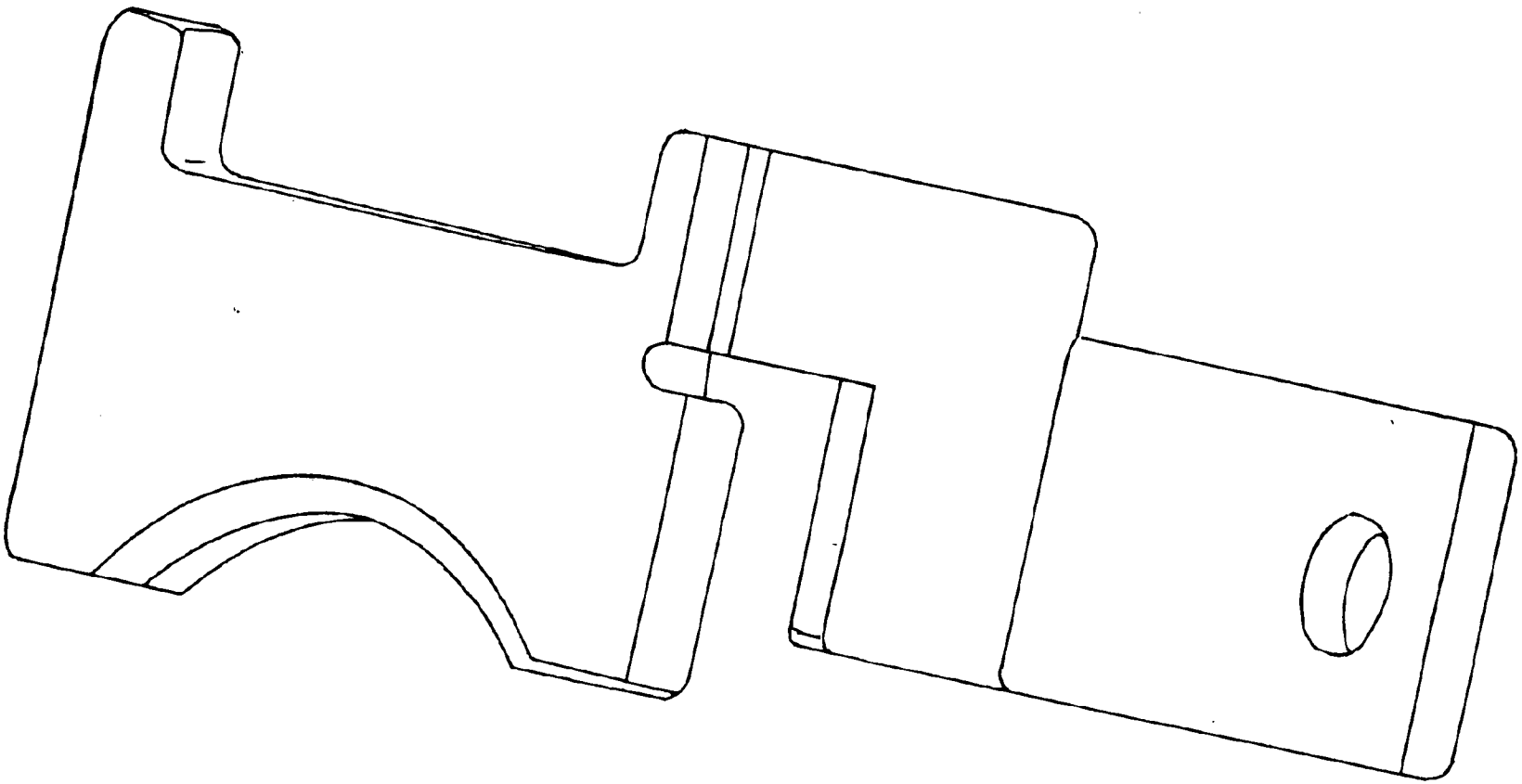

FIG. 20 is a drawing of the shuttle used in the cap feeding system that has the pneumatic top-load coil nailer 3.30 mounted on it. The only difference between this shuttle 3.84 and the shuttle 2.84 is that shuttle 3.84 is bolted to the air cylinder shaft 3.190, whereas shuttle 2.84 is not because shuttle 2.84 is designed to separate from the air cylinder shaft 2.190 to enable the bottom-load staple gun 2.30 to be loaded with staples as described earlier.

Although the present invention has been described and illustrated with respect to preferred embodiments and a preferred use therefor, it is not to be so limited since modifications and changes can be made therein which are within the full intended scope of the invention.

I claim:

1. An improved fastener gun having a magazine holding a plurality of stacked caps, said magazine including pusher means for pushing said plurality of stacked caps through said magazine toward a first end of said magazine, said fastener gun being adapted for sequentially shooting fasteners from a nose through each of said plurality of caps; said plurality of stacked caps having a leading cap adjacent said first end of said magazine; said leading cap having a leading portion and a trailing portion;

wherein the improvement comprises a cap feeding apparatus in combination with said fastener gun, said cap feeding apparatus comprising:

(a) a cap feeding body with a feeding chamber formed therewithin, said feeding chamber having a first end in communication with said first end of said magazine and second end adjacent said nose;

(b) retaining means, in opposition to said pusher means, for opposing emergence of said leading cap from said magazine;

(c) a shuttle mounted for reciprocation within said chamber; said shuffle having a forward edge and a rearward edge; said shuttle reciprocating between:

i. a cap-receiving position in which said leading cap may emerge from said magazine into substantial coplanar relationship with said shuttle forward of said shuttle's forward edge; and ii. a cap-electing position in which said rearward edge of said shuttle retains said leading portion of said leading cap within said magazine;

such that said rearward edge of said shuttle becomes internosed between said retaining means and said leading cap as said shuttle moves from said cap-ejecting position to said cap-receiving position; and (d) a flipper arm mounted about an axis for pivoting movement with respect to said cap feeding body such that said flipper arm engages said leading cap as said leading cap emerges from said second end of said feeding chamber.

2. An improved fastener gun having a magazine holding a plurality of stacked caps, said magazine including pusher means for pushing said plurality of stacked caps through said magazine toward a first end of said magazine, said fastener gun being adapted for sequentially shooting fasteners from a nose through each of said plurality of caps; said plurality of stacked caps having a leading cap adjacent said first end of said magazine; said leading cap having a leading portion and a trailing portion;

wherein the improvement comprises a cap feeding apparatus in combination with said fastener gun, said cap feeding apparatus comprising:

(a) a cap feeding body with a feeding chamber formed therewithin, said feeding chamber having a first end in communication with said first end of said magazine and second end adjacent said nose;

(b) a shuttle mounted for reciprocation within said chamber; said shuffle having a forward edge and a rearward edge; said shuttle reciprocating between:

i. a cap-receiving position in which said leading cap may emerge from said magazine into substantial coplanar relationship with said shuttle forward of said shuttle's forward edge; and ii. a cap-ejecting position in which said leading cap is pushed by said shuttle forward edge to emerge from said feeding chamber in a feed direction; and (c) a flipper arm mounted about an axis for pivoting movement with respect to said cap feeding body such that said flipper arm engages said leading cap as said leading cap emerges from said second end of said feeding chamber and causes said leading cap to flip about a flipping axis transverse to said feed direction.

3. The improved fastener gun as recited in claim 2, in which leading cap is flipped substantially ninety degrees by said flipper arm.

4. The improved fastener gun as recited in claim 2, in which leading cap is flipped substantially ninety degrees by said flipper arm.

5. An improved fastener gun having a magazine holding a plurality of stacked caps, said magazine including pusher means for pushing said plurality of stacked caps through said magazine toward a first end of said magazine, said fastener gun being adapted for sequentially shooting fasteners from a nose through each of said plurality of caps; said plurality of stacked caps having a leading cap adjacent said first end of said magazine; said leading cap having a leading portion and a wailing portion;

wherein the improvement comprises a cap feeding apparatus in combination with said fastener gun, said cap feeding apparatus comprising:

(a) a cap feeding body with a feeding chamber formed therewithin, said feeding chamber having a first end in communication with said first end of said magazine and second end adjacent said nose;

(b) retaining means, in opposition to said pusher means, for opposing emergence of said leading cap from said magazine;

(c) a shuttle mounted for reciprocation within said chamber; said shuttle having a forward edge and a rearward edge; said shuttle reciprocating between:

i. a cap-receiving position in which said leading cap may emerge from said magazine into substantial coplanar relationship with said shuttle forward of said shuttle's forward edge; and ii. a cap-ejecting position in which said rearward edge of said shuttle retains said leading portion of said leading cap within said magazine while said leading cap is pushed by said shuttle forward edge to emerge from said feeding chamber in a feed direction, such that said rearward edge of said shuttle becomes interposed between said retaining means and said leading cap as said shuttle moves from said cap-ejecting position to said cap-receiving position; and (d) a flipper arm mounted about an axis for pivoting movement with respect to said cap feeding body such that said flipper arm engages said leading cap as said leading cap emerges from said second end of said feeding chamber and causes said leading cap to flip about a flipping axis transverse to said feed direction.

* * * * *